US011326297B2

(12) United States Patent
Kim et al.

(10) Patent No.: US 11,326,297 B2
(45) Date of Patent: May 10, 2022

(54) WASHING MACHINE WITH HEATER AND MULTIPLE TUBS AND CONTROL METHOD THEREOF

(71) Applicant: Samsung Electronics Co., Ltd., Suwon-si (KR)

(72) Inventors: Seung-Hoon Kim, Seoul (KR); Jung Chul Choi, Hwaseong-si (KR); Sung Mo Lee, Gunpo-si (KR); Jun Hyun Park, Hwaseong-si (KR); Kyoung-Seop Shin, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 53 days.

(21) Appl. No.: 15/898,977

(22) Filed: Feb. 19, 2018

(65) Prior Publication Data

US 2018/0313014 A1 Nov. 1, 2018

(30) Foreign Application Priority Data

Apr. 28, 2017 (KR) ..... 10-2017-0055645
Apr. 28, 2017 (KR) ..... 10-2017-0055738
Nov. 2, 2017 (KR) ..... 10-2017-0145192

(51) Int. Cl.
*D06F 29/00* (2006.01)
*D06F 31/00* (2006.01)
(Continued)

(52) U.S. Cl.
CPC ..... *D06F 39/04* (2013.01); *D06F 23/02* (2013.01); *D06F 23/04* (2013.01); *D06F 33/32* (2020.02);
(Continued)

(58) Field of Classification Search
CPC ..... D06F 31/00; D06F 29/00; D06F 33/02; D06F 2204/04; D06F 39/005;
(Continued)

(56) References Cited

U.S. PATENT DOCUMENTS 8,186,227 B2 * 5/2012 Ashrafzadeh ..... D06F 33/00 73/760
10,648,123 B2 5/2020 Lv et al.
(Continued)

FOREIGN PATENT DOCUMENTS

CN 101586298 A 11/2009
CN 101994226 A 3/2011
(Continued)

OTHER PUBLICATIONS

Samsung Electronics Co., Ltd., "Samsung Unveils Laundry Game-Changer at CES 2017 with New Four-in-One Laundry System," Samsung Newsroom U.S. [online], Dec. 31, 2016, 2 pages.
(Continued)

*Primary Examiner* — Joseph L. Perrin
*Assistant Examiner* — Irina Graf

(57) ABSTRACT

A washing machine includes a first tub storing water; a first drum provided to be rotatable in the first tub; a first driving motor for rotating the first drum; a second tub storing water; a second drum provided to be rotatable in the second tub; a second driving motor for rotating the second drum; at least one heater for heating water stored in at least one of the first tub and the second tub; and a controller configured to determine whether the at least one heater and the second driving motor are operating at a time to operate the first driving motor, and control operation of the second driving motor to be stopped and control the first driving motor to be operated when the at least one heater and the second driving motor are operating.

10 Claims, 30 Drawing Sheets

(51) Int. Cl.

| | |
|---|---|
| ***D06F 37/42*** | (2006.01) |
| ***D06F 33/32*** | (2020.01) |
| ***D06F 39/04*** | (2006.01) |
| ***D06F 23/02*** | (2006.01) |
| ***D06F 23/04*** | (2006.01) |
| *D06F 103/24* | (2020.01) |
| *D06F 103/46* | (2020.01) |
| *D06F 105/10* | (2020.01) |
| *D06F 105/46* | (2020.01) |
| *D06F 105/52* | (2020.01) |

(52) U.S. Cl.
CPC ..... *D06F 29/00* (2013.01); *D06F 31/00* (2013.01); *D06F 2103/24* (2020.02); *D06F 2103/46* (2020.02); *D06F 2105/10* (2020.02); *D06F 2105/46* (2020.02); *D06F 2105/52* (2020.02)

(58) Field of Classification Search
CPC ..... D06F 2202/04; D06F 2216/00; D06F 29/005; D06F 2202/12; D06F 2212/02; D06F 2220/00; D06F 2058/2883; D06F 34/18; D06F 2202/10; D06F 2204/065; D06F 2103/04; D06F 33/00; D06F 2204/06
See application file for complete search history.

(56) References Cited

U.S. PATENT DOCUMENTS

| | | | | |
|---|---|---|---|---|
| 2009/0133197 | A1 | 5/2009 | Lee et al. | |
| 2009/0307851 | A1 | 12/2009 | Bae et al. | |
| 2011/0041258 | A1 | 2/2011 | Ko et al. | |
| 2011/0047716 | A1* | 3/2011 | Cho | D06F 37/306 8/137 |
| 2014/0189959 | A1* | 7/2014 | Dokonal | D06F 33/00 8/137 |

FOREIGN PATENT DOCUMENTS

| | | | | |
|---|---|---|---|---|
| CN | 105734915 | A | 7/2016 | |
| KR | 2000-0067549 | A | 11/2000 | |
| KR | 10-2009-0121996 | A | 11/2009 | |
| KR | 10-2011-0019082 | A | 2/2011 | |
| WO | 2008/026942 | A1 | 3/2008 | |
| WO | 2016/090968 | A1 | 6/2016 | |
| WO | WO-2016137182 | A1 * | 9/2016 | D06F 29/005 |

OTHER PUBLICATIONS

Samsung Electronics Co., Ltd., "Samsung Electronics, 'Connectivity' and 'Consumer Care Innovation' will lead to future home appliances and future home change," Samsung Newsroom U.S. [online], Jan. 5, 2017, 7 pages.
Samsung Electronics Co., Ltd., "'All-in-one washing solution' Flex Wash—Flex dry until birth," Samsung Newsroom U.S. [online], Jan. 5, 2017, 8 pages.
Samsung Electronics Co., Ltd., "Samsung to release 'Flex Wash' for CES," ZDNet Korea news print [online], Jan. 1, 2017, 4 pages.
ISA/KR, "International Search Report," International Application No. PCT/KR2018/000887, dated May 18, 2018, 6 pages.
ISA/KR, "Corrected Version—International Search Report," International Application No. PCT/KR2018/000887, dated Sep. 10, 2018, 7 pages.
Office Action dated Jul. 23, 2021 in connection with Chinese Patent Application No. 201810166429.6, 29 pages.
Office Action dated Jun. 13, 2021 in connection with India Patent Application No. 201947048341, 6 pages.
Notice of Preliminary Rejection dated Dec. 17, 2021 in connection with Korean Patent Application No. 10-2017-0145192, 13 pages.

* cited by examiner

WASHING MACHINE WITH HEATER AND MULTIPLE TUBS AND CONTROL METHOD THEREOF

CROSS-REFERENCE TO RELATED APPLICATIONS AND CLAIM OF PRIORITY

This application is related to and claims priority to Korean Patent Application No. 10-2017-0055645, filed on Apr. 28, 2017, Korean Patent Application No. 10-2017-0055738, filed on Apr. 28, 2017, and Korean Patent Application No. 10-2017-0145192, filed on Nov. 2, 2017, the contents of which are incorporated herein by reference.

TECHNICAL FIELD

The present disclosure relates to a washing machine, and more particularly, to a washing machine with multiple tubs and control method of the washing machine.

BACKGROUND

In general, washing machines are devices for doing the laundry by rotating its cylindrical spinning tub that contains laundry.

As for types of the washing machine, there are washers in which a drum is horizontally positioned to do the laundry by raising and dropping the laundry along the inner wall of the drum while rotating around the horizontal axis, and washers in which a drum having a pulsator therein is vertically positioned to do the laundry using water currents produced by the pulsator while the drum is rotating around the vertical axis.

The washer in which the drum is horizontally positioned is called a front loading washer because a laundry inlet is formed on the front, and the washer in which the drum is vertically positioned is called a top loading washer because a laundry inlet is formed on the top.

Typical washing machines employ one of the two types to do the laundry.

SUMMARY

To address the above-discussed deficiencies, it is a primary object to provide a washing machine equipped with a front-loading type washing device and a top-loading type washing device and control method of the washing machine.

The present disclosure also provides a washing machine equipped with multiple washing devices and control method thereof, to limit the power consumption to no more than the upper limit.

The present disclosure also provides a washing machine and control method thereof, to prevent collisions between parts that are likely to occur during washing or dehydrating operation.

The present disclosure also provides a washing machine and control method thereof, to properly control washing and dehydration based on the property of the load to maximize the washing and dehydration performance.

In accordance with one aspect of the present disclosure, a washing machine includes a first tub storing water; a first drum provided to be rotatable in the first tub; a first driving motor for rotating the first drum; a second tub storing water; a second drum provided to be rotatable in the second tub; a second driving motor for rotating the second drum; at least one heater for heating water stored in at least one of the first tub and the second tub; and a controller configured to determine whether the at least one heater and the second driving motor are operating at a time to operate the first driving motor, and control operation of the second driving motor to be stopped and control the first driving motor to be operated when the at least one heater and the second driving motor are operating.

The controller is configured to control operation of the second driving motor after the lapse of a reference time from when the operation of the second driving motor is stopped.

The washing machine may further include: a current measurer for measuring a driving current for the first driving motor. The controller is configured to determine whether the measured driving current for the first driving motor is greater than a predetermined reference current when the at least one heater, the first driving motor, and the second driving motor are operating simultaneously, and control operation of the second driving motor to be stopped when the measured driving current for the first driving motor is greater than the reference current.

The controller is configured to control operation of the second driving motor when the measured driving current for the first driving motor becomes smaller than the predetermined reference current.

The controller is configured to determine whether the at least one heater and the first driving motor are operating while the second drum is performing a dehydrating course, control operation of the at least one heater to be stopped when the at least one heater and the first driving motor are operating, and control operation of the at least one heater when the dehydration course is completed.

The controller is configured to control the second driving motor to be rotated in a first direction with first acceleration for a predetermined time in controlling operation of the second driving motor, and control the second driving motor to be rotated in a second direction with second acceleration after the lapse of the predetermined time. The first acceleration is less than the second acceleration. The first direction is a rotational direction opposite to the second direction.

The controller is configured to determine a first parameter for controlling operation of the second drum, control the second drum based on a second parameter when the second drum performs an initial operation, determine whether an additional operation of the second drum is required, and control operation of the second drum based on the first parameter when it is determined that the additional operation of the second drum is not required.

The first parameter comprises at least one of a first operation ratio of the second drum, a first rotational acceleration of the second drum, and a first rotational deceleration of the second drum. The second parameter comprises at least one of a second rotational acceleration, which is less than the first rotational acceleration, and a second rotational deceleration having an absolute value less than the first rotational deceleration.

The controller is configured to determine that the additional operation of the second drum is required when rotational speed of the second drum has not yet reached a target rotational speed, when an overcurrent is applied to the second driving motor, or when there is unbalanced distribution of laundry in the second drum.

The controller is configured to set a load of the second drum to a first load, control operation of the second driving motor based on the first load, determine a load switching condition at a time to stop operation of the second drum, set the load of the second drum to a second load when it is determined that the load switching condition is met, and control operation of the second driving motor based on the second load, in controlling operation of the second driving motor.

The load switching condition comprises at least one of whether the rotational speed of the second drum exceeds reference speed, whether the rotational acceleration of the second drum exceeds reference acceleration, and an error between target rotational speed and actual rotational speed.

The controller is configured to determine at least one of a difference between the magnitude of a current applied to the second driving motor and a predetermined reference magnitude and a difference between the frequency of a current applied to the second driving motor and a predetermined reference frequency when the load of the washing machine is set to the second load, and set the load of the second drum back to the first load when the at least one difference exceeds a predetermined reference value.

The controller comprises a first processor configured to control the first driving motor and a second processor configured to control the second driving motor. The first processor is configured to send a first driving signal to the second processor while controlling operation of the first driving motor when the at least one heater is operating. The second processor is configured to control operation of the second driving motor to be stopped in response to the first driving signal from the first processor.

The first processor is configured to send the first driving signal to the second processor when the heater is operating and the first driving current of the first driving motor is greater than a predetermined reference current, and wherein the second processor is configured to control operation of the second driving motor to be stopped in response to the first driving signal from the first processor.

The second processor is configured to send a second driving signal to the first processor while controlling operation of the second driving motor to dehydrate laundry contained in the second drum. The first processor is configured to control operation of the heater to be stopped in response to the second driving signal when the first driving motor and the heater are operating.

In accordance with another aspect of the present disclosure, a control method of a washing machine, the method includes: rotating at least one of a first drum and a second drum based on an operation command input to a control panel; and operating a heater for heating water stored in a first tub containing the first drum based on the operation command input to the control panel. The rotating of the at least one of the first drum and the second drum comprises: determining whether the heater is operating and simultaneously, the second drum is rotating at a time to rotate the first drum, stopping rotation of the second drum and operating the first drum when the heater is operating and simultaneously, the second drum is rotating, and rotating the second drum again after the lapse of a reference time from when rotation of the second drum is stopped.

The control method may further include: determining whether the heater is operating and simultaneously, the first drum is rotating when the second drum is performing a dehydration course; stopping operation of the heater when the heater is operating and simultaneously, the first drum is rotating; and operating the heater again when the second drum stops the dehydration course.

The control method may further include: measuring a driving current of the second driving motor coupled to the first drum while the heater is operating and simultaneously, both the first drum and the second drum are rotating; and stopping the rotation of the second drum when the measured current is greater than a predetermined reference current.

The rotating of the at least one of the first drum and the second drum comprises: setting a load to a first load; rotating at least one of the first drum and the second drum based on the first load; determining a load switching condition at a time to stop rotation of at least one of the first drum and the second drum; setting the load to a second load, which is lower than the first load, when it is determined that the load switching condition is met; rotating at least one of the first drum and the second drum based on the set second load.

The load switching condition comprises: at least one of whether the rotational speed of at least one drum exceeds reference speed, whether the rotational acceleration of the at least one drum exceeds reference acceleration, and an error between target rotational speed and actual rotational speed.

The control method may further include: determining a difference between the magnitude of a current applied to a driving motor of at least one drum and a predetermined reference magnitude after the load is set to the second load; determining a difference between the frequency of a current applied to a driving motor of the at least one drum and a predetermined reference frequency; and setting the load back to the first load when the difference from the reference magnitude exceeds a predetermined reference value or when the difference from the reference frequency exceeds a predetermined reference value.

The rotating of the at least one of the first drum and the second drum comprises: determining a first parameter corresponding to rotation of at least one of the first drum and the second drum; rotating the at least one of the first drum and the second drum based on a second parameter, which is different from the first parameter, when operation of the at least one of the first drum and the second drum is an initial operation; determining whether additional operation of the at least one of the first drum and the second drum needs to be performed; and rotating the at least one of the first drum and the second drum based on the first parameter when it is determined that the additional operation does not need to be performed.

The determining of whether additional operation of the at least one of the first drum and the second drum needs to be performed comprises: determining whether additional operation of the at least one of the first drum and the second drum needs to be performed based on the second parameter based on at least one of a movement form of a water stream in the at least one of the first drum and the second drum, a movement form of laundry in the at least one of the first drum and the second drum, an unbalanced level of the laundry, rotational speed of the at least one of the first drum and the second drum, vibration of the at least one of the first drum and the second drum, and a current applied to a driving motor for driving the at least one of the first drum and the second drum.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
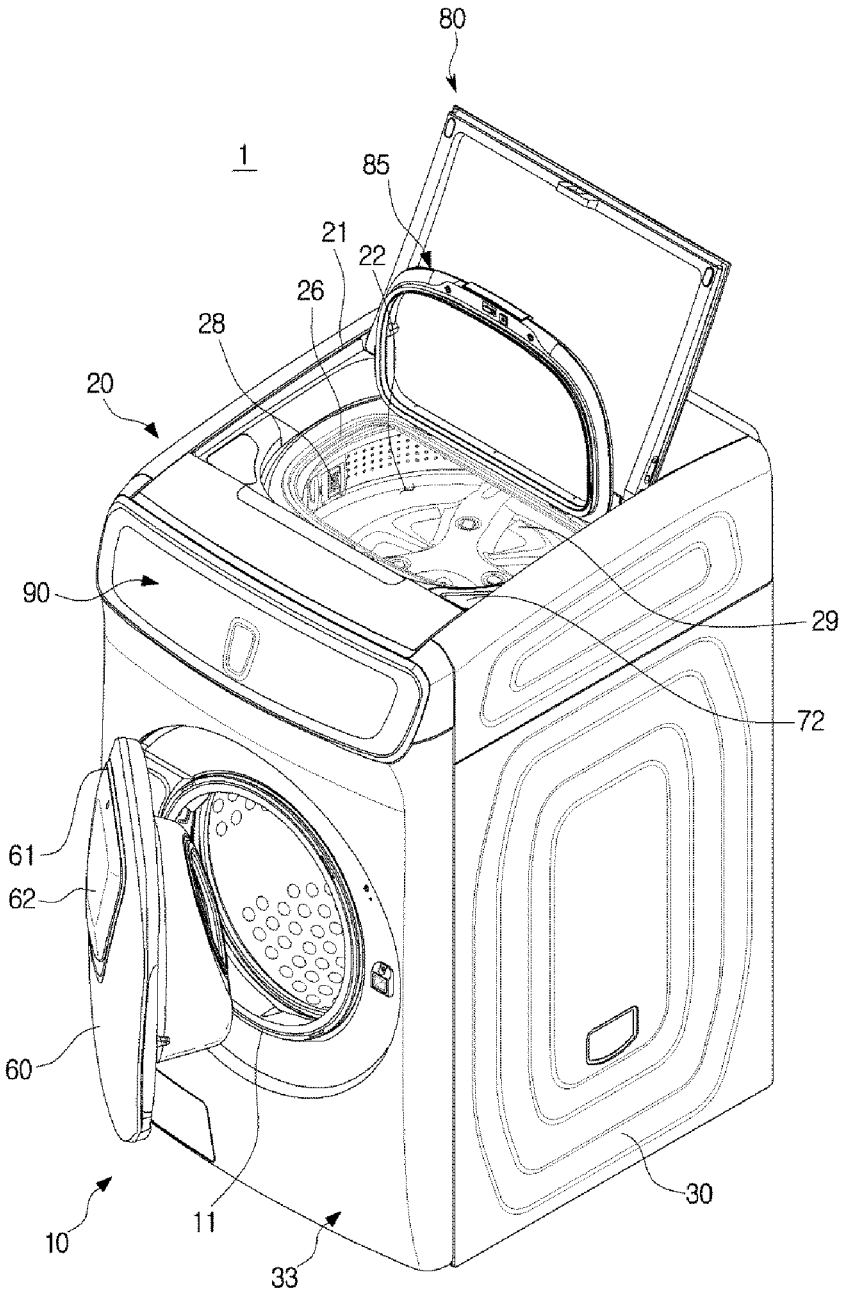
FIG. 1 shows the exterior of a washing machine, according to an embodiment of the present disclosure.

FIGS. 1 through 30, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Like numerals refer to like elements throughout the specification. Not all elements of embodiments of the present disclosure will be described, and description of what are commonly known in the art or what overlap each other in the embodiments will be omitted. The terms as used throughout the specification, such as "~part", "~module", "~member", "~block", etc., may be implemented in software and/or hardware, and a plurality of "~parts", "~modules", "~members", or "~blocks" may be implemented in a single element, or a single "~part", "~module", "~member", or "~block" may include a plurality of elements.

It will be further understood that the term "connect" or its derivatives refer both to direct and indirect connection, and the indirect connection includes a connection over a wireless communication network.

The term "include (or including)" or "comprise (or comprising)" is inclusive or open-ended and does not exclude additional, unrecited elements or method steps, unless otherwise mentioned.

Throughout the specification, when it is said that a member is located "on" another member, it implies not only that the member is located adjacent to the other member but also that a third member exists between the two members.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

It is to be understood that the singular forms "a," "an," and "the" include plural references unless the context clearly dictates otherwise.

Reference numerals used for method steps are just used for convenience of explanation, but not to limit an order of the steps. Thus, unless the context clearly dictates otherwise, the written order may be practiced otherwise.

The principle and embodiments of the present disclosure will now be described with reference to accompanying drawings.

Figure 2:
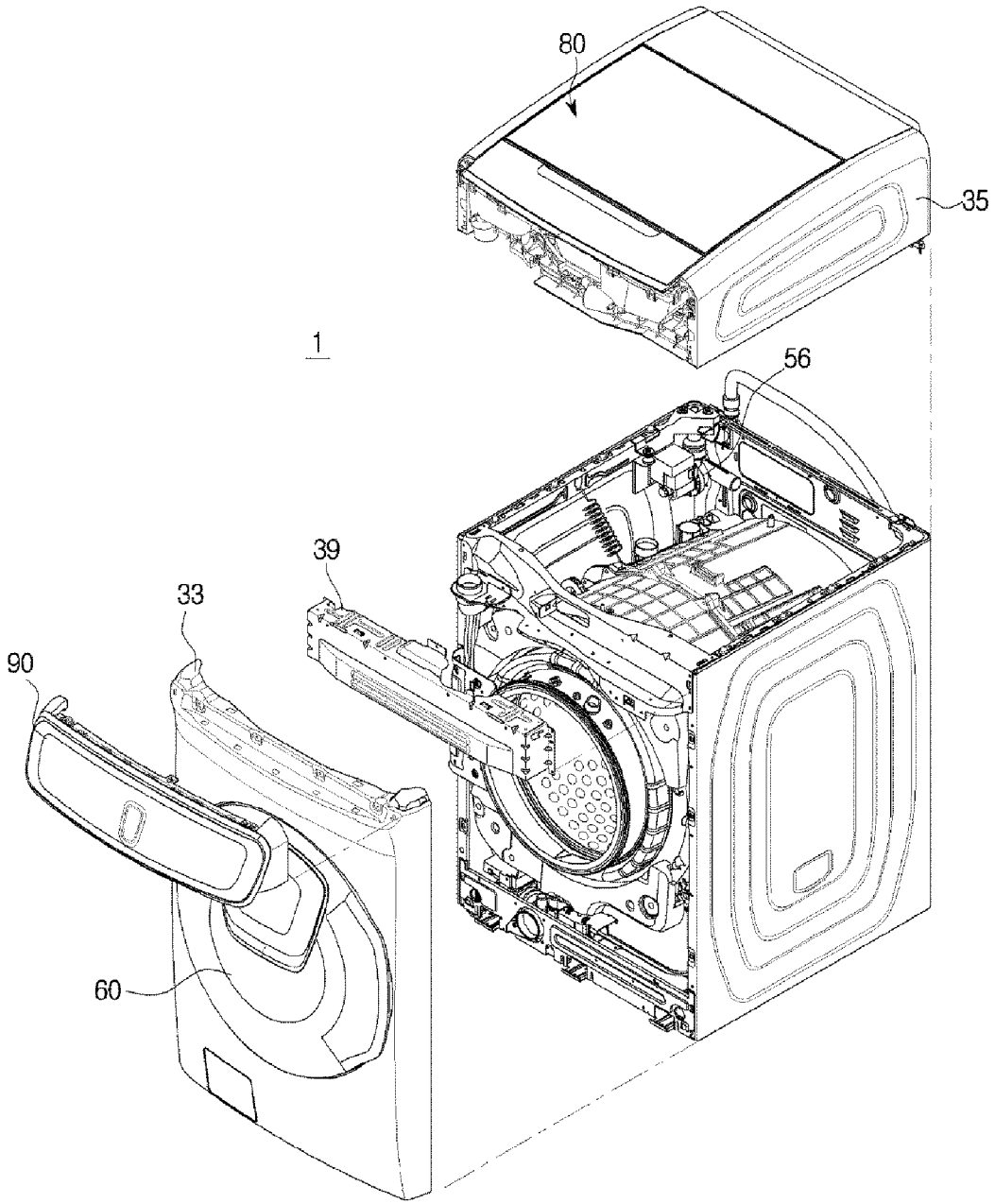
FIG. 2 shows a washing machine with a first washing device and a second washing device separated, according to an embodiment of the present disclosure.
Figure 3:
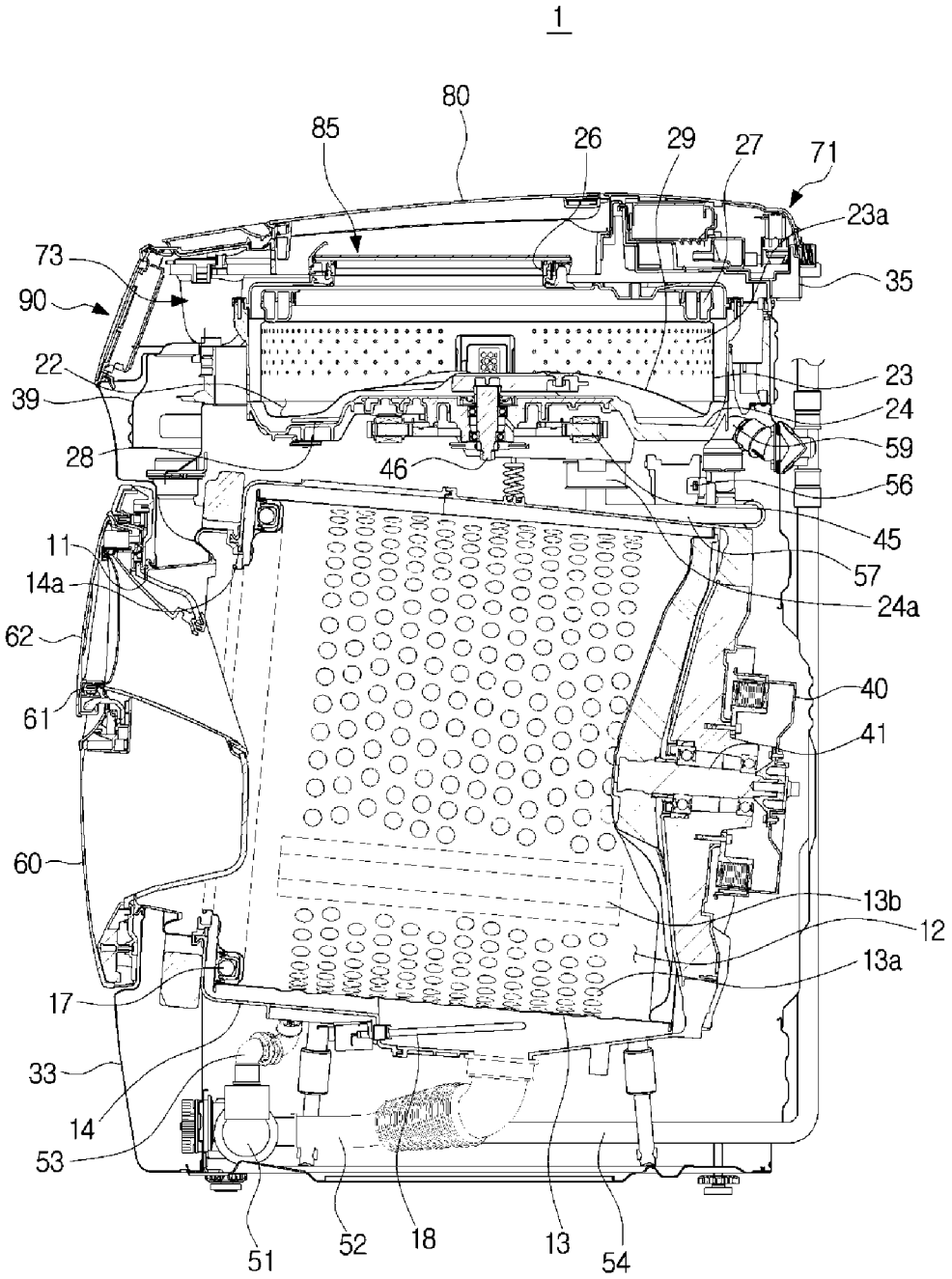
FIG. 3 is a cross-sectional view of a washing machine, according to an embodiment of the present disclosure.
Figure 4:
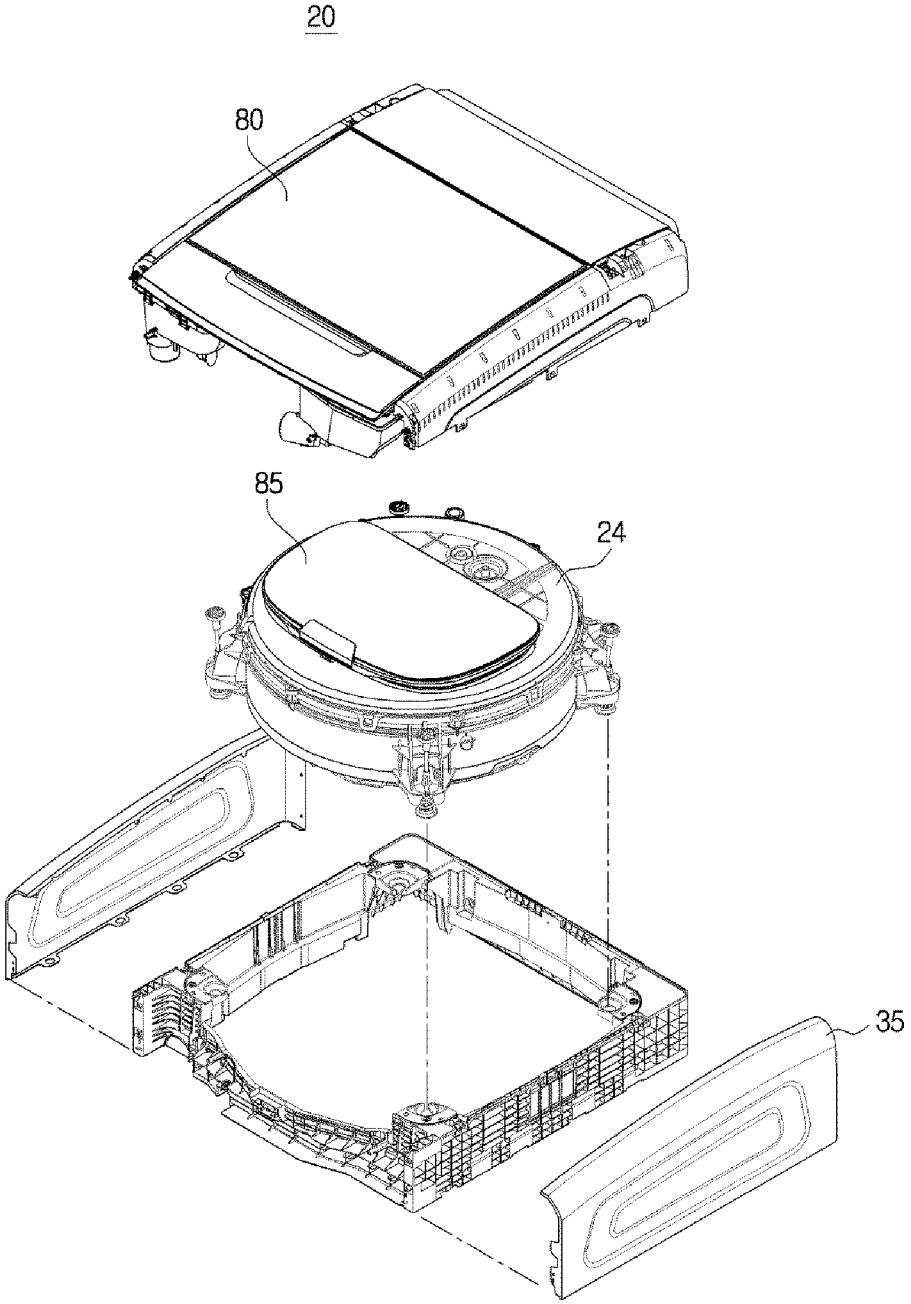
FIG. 4 is an exploded view of a second housing of the washing machine shown in FIG. 2.
Figure 5:
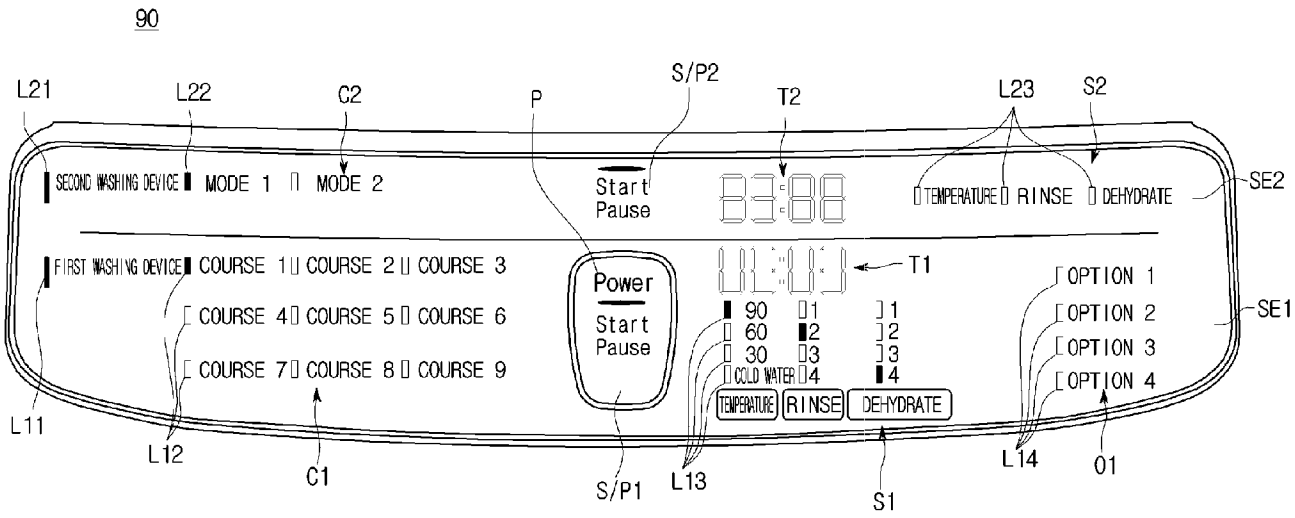
FIG. 5 shows a control panel of a washing machine, according to an embodiment of the present disclosure.

FIG. 1 shows the exterior of a washing machine, according to an embodiment of the present disclosure, FIG. 2 is an exploded view of a washing machine where a first washing device and a second washing device are separated, according to an embodiment of the present disclosure, FIG. 3 is a cross-sectional view of a washing machine, according to an embodiment of the present disclosure, FIG. 4 is an exploded view of a second washing device of the washing machine shown in FIG. 2, and FIG. 5 shows a control panel of a washing machine, according to an embodiment of the present disclosure.

A washing machine 1 may include various mechanical devices for doing the laundry.

For example, as shown in FIGS. 1 to 4, the washing machine 1 may include a first washing device 10 of a front-loading type with a first laundry inlet 11 formed on the front, and a second washing device 20 of a top-loading type with a second laundry inlet 21 formed on the top. The second washing device 20 may be installed above the first washing device 10.

It is, however, merely an example, and it is also possible that both the first washing device 10 and the second washing device 20 are implemented in the front-loading type or in the top-loading type.

Furthermore, the first washing device 10 and the second washing device 20 may be vertically arranged as shown in FIGS. 1 to 3, or may be horizontally arranged in parallel.

The first washing device 10 may include a first drum 13 in which a first washing space is formed and a first tub 14 containing the first drum 13 and storing water for washing or rinsing to be used in a washing course or a rinsing course. The first drum 13 and the first tub 14 may be shaped like a cylinder with at least a portion of a side opened, and the open portion may be positioned almost toward the front.

The washing machine 1 may include a first housing 30 containing the first washing device 10.

The first washing device 10 may include a first driving motor 40 arranged behind the first tub 14 to rotate the first drum 13. A first driving shaft 41 may be provided on the rear side of the first drum 13 for transferring power from the first driving motor 40.

A lot of first through holes 13*a* may be formed along the circumference of the first drum 13 for water circulation. On the inner circumference of the first drum 13, a plurality of lifters 13*b* may be provided to enable the laundry to be moved up and down while the first drum 13 is rotating. A first balancer 17 may be equipped on a front portion of the first drum 13 to help the first drum 13 stably spin at high speed.

The first driving shaft 41 may be arranged between the first drum 13 and the first driving motor 40. The first driving shaft 41 may be coupled to the back plate of the first drum 13 at one end, may pass through the back wall of the first tub 14, extend to the outside of the back wall of the first tub 14, and may be coupled to the first driving motor 40 at the other end. When the first driving motor 40 rotates the first driving shaft 41, the first drum 13 coupled to the first driving shaft 41 is rotated around the first driving shaft 41.

The first washing device 10 may do the laundry with hot water. To obtain hot water, a first heater 18 may be provided on the bottom of the first tub 14 to heat the water stored in the first tub 14. The first washing device 10 may further include a temperature sensor for detecting the temperature of the water contained in the first tub 14.

The first washing device 10 may include a first drain pump 51 arranged in a lower portion of the first tub 14 for draining the water out of the washing machine 1 from inside the first tub 14, a first coupling hose 52 coupling a first drain 14*a* of the first tub 14 and the first drain pump 51 for allowing the water inside the first tub 14 to flow into the first drain pump 51, a circulation hose 53 coupling the first drain pump 51 and the first tub 14 for circulating the water flowing into the first drain pump 51 to the first tub 14, and a first drain hose 54 for guiding the water pumped by the first drain pump 51 to the outside of the washing machine 1.

The washing machine 1 may include a front cover 33 with the first laundry inlet 11 through which laundry (e.g., clothes) may be thrown into the first washing space 12 of the first washing device 10. A first door 60 may be arranged on the front cover 33 for opening or closing the first laundry inlet 11.

The first door 60 may be arranged to correspond to the first laundry inlet 11 and to be able to pivot on the front cover 33.

The first door 60 may have an auxiliary laundry inlet 61 through which to throw clothes into the first washing space 12 while the first door 60 is closed, and an auxiliary door 62 to open or close the auxiliary laundry inlet 61.

The user may be able to easily throw the laundry into the first drum 13 through the auxiliary laundry inlet 61.

An embodiment where the auxiliary door 61 is equipped on the first door 60 has thus far been described, but it is not limited thereto.

The second washing device 20 may include a second drum 23 in which a second washing space 22 is formed and a second tub 24 containing the second drum 23 and storing water to be used in a washing course or a rinsing course. The second drum 23 and the second tub 24 may be shaped like a cylinder with at least a portion of a side open, and the open portion may be positioned almost toward the top.

The second washing device 20 may include a second housing 35. A second laundry inlet 21 may be formed to correspond to a second opening 26 of the second tub 24.

The second washing device 20 may include a second door 80 to open or close the second laundry inlet 21. The second door 80 may be arranged to correspond to the second laundry inlet 21 and to be able to pivot on the housing 35.

The second door 80 may be formed with a transparent material allowing the inside of the second washing space 22*ub* 22 and the content in the second washing space 22 to be seen from outside of the washing machine 1 while the second door 80 closes the second laundry inlet 21.

The second drum 23 may have a cylindrical form with the open top and may be arranged to be able to rotate within the second tub 24. A lot of second through holes 23*a* may be formed in the side of the second drum 23 for water circulation. A second balancer 27 may be equipped on an upper portion of the second drum 23 to help the second drum 23 stably spin at high speed.

There may be a curved portion 29 formed on the bottom of the second drum 23 for creating water streams. Furthermore, a pulsator may be formed on the bottom of the second drum 23 to create water streams.

The second opening 26 may be formed on the top of the second tub 23 to correspond to the second laundry inlet 21, and there may be an internal door 85 provided to open or close the second opening 26. The internal door 85 may prevent water for washing or rinsing from leaking out during a washing or rinsing course.

The internal door 85 may be pivotally mounted on the second tub 24. On a side of the internal door 85, a door handle is provided for the user to open the internal door 85. The internal door 85 may be formed with a transparent material allowing the inside of the second drum 23 to be seen even while the internal door 85 closes the second opening 26.

The second washing device 20 may include a second driving motor 45 arranged under the outside of the second tub 24 to rotate the second drum 23. A second driving shaft 46 may be provided on the bottom side of the second drum 23 for transferring power from the second driving motor 45. The second driving shaft 46 may be coupled to the bottom side of the second drum 23 at one end, may pass through the lower wall of the second tub 24, extend to the outside of the lower wall of the second tub 24, and may be coupled to the second driving motor 45 at the other end. When the second driving motor 45 rotates the second driving shaft 46, the second drum 23 coupled to the second driving shaft 46 may be rotated around the second driving shaft 46.

If the pulsator is arranged on the bottom of the second drum 23 in some embodiments, the second washing device 20 may further include a clutch device to transfer the driving force produced by the second driving motor 45 to the second drum 23 and the pulsator simultaneously or selectively.

The second washing device 20 may do the laundry with hot water. To obtain hot water, a second heater 28 may be provided on the bottom of the second tub 24 to heat the water stored in the second tub 24. The second washing device 20 may further include a temperature sensor for detecting the temperature of the water contained in the second tub 24.

The second washing device 20 may include a second drain pump 56 to drain water inside the second tub 24 out of the washing machine 1, and the second drain pump 56 may be fixed on the top of the first housing 30 of the first washing device 10. The second washing device 20 may further include a second drain hose 59 to guide the water pumped by the second drain pump 56 to the outside of the washing machine 1.

A second drain 24*a* is formed on the bottom of the second tub 24 to drain water out of the second tub 24, and a second coupling hose 57 is provided between the second drain 24*a* and the second drain pump 56 to guide the water of the second tub 24 to the second drain pump 56.

The washing machine 1 includes a water supplier 71 for supplying water to the first tub 14 of the first washing device 10 and the second tub 24 of the second washing device 20.

For example, the water supplier 71 may include a first water supply tube extending from an external water source to the first tub 14, and a first water supply valve arranged in the first water supply tube to allow water to be supplied or block water from being supplied to the first tub 14. Furthermore, the water supplier 71 may include a second water supply tube extending from the external water source to the second tub 24, and a second water supply valve arranged in the second water supply tube to allow water to be supplied or block water from being supplied to the second tub 24.

The water supplier 71 is arranged inside the second housing 35 of the second washing device 20. For example, the water supplier 71 may be arranged behind the second laundry inlet 21.

The washing machine 1 includes a first detergent supplier 73 for supplying a detergent and/or a fabric softener to the first washing device 10 and a second detergent supplier 72 for supplying a detergent and/or fabric softener to the second washing device 20.

Water may be supplied to the first tub 14 via the first detergent supplier 73, and while the water passes the first detergent supplier 73, the detergent may be supplied to the first tub 14 along with the water.

The washing machine 1 may include a fixing bracket 39 to securely combine the first washing device 10 and the second washing device 20. The fixing bracket 39 may fix the first washing device 10 and the second washing device 20 at the front of the first and second washing devices 10 and 20.

A control panel 90 may be provided in an upper portion of the front cover 33. The control panel 90 may include an input for receiving inputs about operations of the first and second washing devices 10 and 20 from the user and a display for displaying information about operations of the first and second washing devices 10 and 20 to the user.

As shown in FIG. 5, the control panel 90 may include a first section SE1 to receive inputs of operations of the first washing device 10 and display information about operation of the first washing device 10, and a second section SE2 to receive inputs of operations of the second washing device 20 and display information about operation of the second washing device 20.

The control panel 90 may display a power button P in the center to control on/off of the power of the washing machine 1. When the power button P is touched or pushed, the control panel 90 may receive a command to turn on the power.

Once the command to turn on the power is input as the power button P is touched or pushed, power may be supplied to the washing machine 1. The control panel 90 may display various selectable objects.

In the first section SE1, a first start/pause button S/P1 to start and/or pause operation of the first washing device 10, a first washing course button C1 that may select a washing course to be performed by the first washing device 10, a first details setting button S1 to select setting details, such as a water temperature, the number of rinsing times, a dehydration level, etc., depending on the selected washing course, and a first option selection button O1 to select an option such as cleaning of the first washing device 10.

Furthermore, in the first section SE1, a first activation indicator L11 to indicate whether the first washing device 10 is activated, a first course indicator L12 to indicate a selected washing course, a first setting indicator L13 to indicate a selected setting detail, a first option indicator L14 to indicate a selected option, and a first time indication panel T1 to indicate time of operation of the first washing device 10 may further be provided.

In the second section SE2, a second start/pause button S/P2 to start and/or pause operation of the second washing device 20, a second washing course button C2 that may select a washing course to be performed by the second washing device 20, and a second details setting button S2 to select second setting details, such as a water temperature, the number of rinsing times, a dehydration level, etc., depending on the selected washing course may be provided.

Furthermore, in the second section SE2, a second activation indicator L21 to indicate whether the second washing device 20 is activated, a second course indicator L22 to indicate a selected washing course, a second setting indicator L23 to indicate a selected setting detail, and a second time indication panel T2 to indicate time of operation of the second washing device 20 may further be provided.

Figure 6:
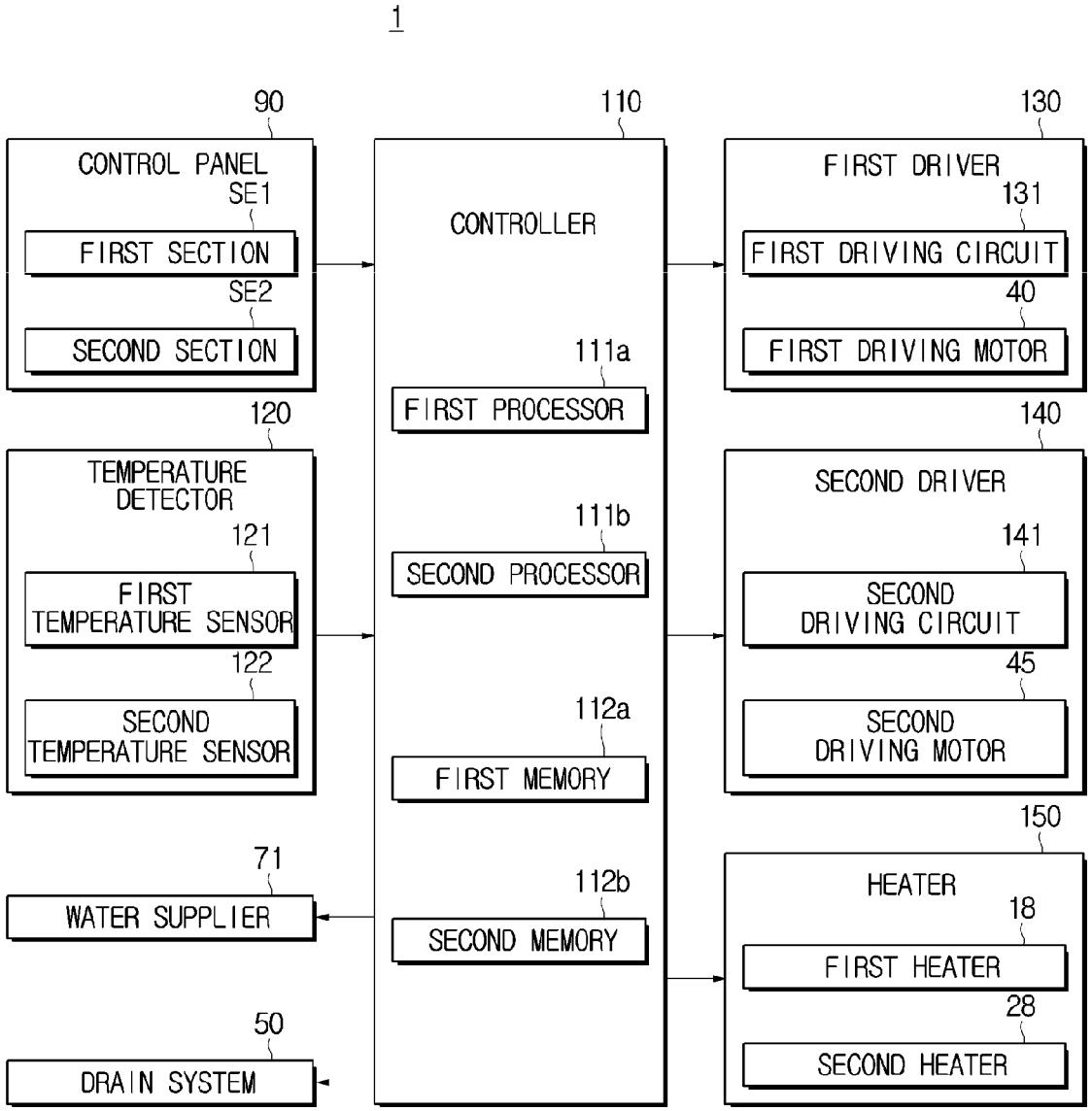
FIG. 6 is a control block diagram of a washing machine, according to an embodiment of the present disclosure.

FIG. 6 is a control block diagram of a washing machine, according to an embodiment of the present disclosure.

The washing machine 1 may include an electric device for controlling operation of mechanical devices included in the washing machine 1.

As shown in FIG. 6, the washing machine 1 may include the control panel 90, a temperature detector 120, the water supplier 71, a drain system 50, a first driver 130, a second driver 140, a heater 150, and a controller 110.

The control panel 90 may include the first section SE1 and the second section SE2.

The control panel 90 may output an input about an operation of the first washing device 10 received from the user through the first area SE1 to the controller 110, and output an input about an operation of the second washing device 20 received from the user through the second area SE2 to the controller 110.

The shape and function of the control panel 90 is the same as what is described above in connection with FIG. 5.

The temperature detector 120 may include a first temperature sensor 121 for measuring the temperature of water contained in the first tub 14 and a second temperature sensor 122 for measuring the temperature of water contained in the second tub 24.

The first temperature sensor 121 is installed inside the first tub 14 for outputting an electric signal corresponding to the temperature of water contained in the first tub 14 to the controller 110. For example, the first temperature sensor 121 may include a thermistor whose electric resistance is changed according to the temperature.

The second temperature sensor 122 is installed inside the second tub 24 for outputting an electric signal corresponding to the temperature of water contained in the second tub 24 to the controller 110. For example, the second temperature sensor 122 may also include a thermistor.

The water supplier 71 may supply water to the first tub 14 of the first washing device 10 and/or the second tub 24 of the second washing device 20 from an external water source. The drain system 50 may drain water contained in the first tub 14 of the first washing device 10 and/or in the second tub 24 of the second washing device 20 to the outside of the washing machine 1.

The first driver 130 may include the first driving motor 40 for rotating the first drum 13 and a first driving circuit 131 for applying a first driving current to the first driving motor 40.

The first driving motor 40 may produce rotational force from the power of an external power source and transfer the rotational force to the first drum 131 through the first driving shaft 41. The first driving motor 40 may employ a brushless direct current motor (BLDC) motor or a synchronous motor that easily controls rotation speed. Alternatively, the first driving motor 40 may employ an inexpensive direct current motor (DC motor) or an induction motor.

The first driving circuit 131 may apply the first driving current to the first driving motor 40 in response to a control signal from the controller 110. For example, the first driving circuit 131 may include an inverter circuit for applying the first driving current calculated based on a first speed instruction from the controller 110 and a rotation speed of the first driving motor 40 to the first driving motor 40. Furthermore, the first driving circuit 131 may include a power switching circuit to allow or block the current from being applied to the first driving motor 40 in response to an on/off instruction from the controller 110.

The washing machine may further include a current measurer for detecting a current applied to the first driving motor 40.

The second driver 140 may include the second driving motor 45 for rotating the second drum 23 and a second driving circuit 141 for applying a second driving current to the second driving motor 45.

The second driving motor 45 may produce rotational force from the power of an external power source and transfer the rotational force to the second drum 23 through the second driving shaft 46. The second driving motor 45 may employ a BLDC motor, a synchronous motor, a DC motor, or an induction motor.

The second driving circuit 141 may apply the second driving current to the second driving motor 45 in response to a control signal from the controller 110, and may include an inverter circuit or a power switching circuit.

The washing machine may further include a current measurer for detecting a current applied to the second driving motor 45.

The heater 150 may include a first heater 18 for heating the water contained in the first tub 14 and a second heater 28 for heating the water contained in the second tub 24.

The first heater 18 may include an electric resistor heated by electric power and a switching circuit for controlling the power to be supplied to the electric resistor. The first heater 18 may heat the water contained in the first tub 14 according to a control signal from the controller 110.

The second heater 28 may include an electric resistor and a switching circuit and may heat the water contained in the second tub 24 according to a control signal of the controller 110. The controller 110 may include first and second memories 112*a* and 112 for memorizing/storing the program and data for controlling operation of the washing machine 1, and first and second processors 111*a* and 111*b* for creating control signals to control operation of the washing machine 1 according to the program and data memorized/stored in the first and second memories 112*a* and 112*b*. The first and second processors 111*a* and 111*b* and the first and second memories 112*a* and 112*b* may be implemented in separate chips or in a single chip.

The first and second memories 112*a* and 112*b* may store a control program and control data for controlling operation of the washing machine 1 and store various application programs and application data for performing various functions according to the user's input. Furthermore, the first and second memories 112*a* and 112*b* may memorize the user's input received through the control panel 90, or memorize the temperature of water contained in the first tub 14 and/or the second tub 24 detected by the temperature detector 120.

The first and second memories 112*a* and 112*b* may include volatile memories, such as Static Random Access Memories (S-RAMs), Dynamic RAMs (D-RAMs), or the like for temporarily storing data, and non-volatile memories, such as Read Only Memories (ROMs), Erasable Programmable ROMs (EPROMs), Electrically Erasable Programmable ROMs (EEPROMs), flash memories or the like for storing data for a long time.

The first and second processors 111*a* and 111*b* may include logic circuits and operation circuits to process data under a program provided from the first and second memories 112*a* and 112*b* and create a control signal according to the result of the process.

The first and second processors 111*a* and 111*b* may communicate with each other.

For example, the first and second processors 111*a* and 111*b* may process the user's input received from the control panel 90 and an output of the temperature of the temperature detector 120, and create control signals to perform a washing course, a rinsing course, and a dehydrating course according to the user's input and the temperature output.

Specifically, the first and second processors 111*a* and 111*b* may output a water supply signal to the water supplier to supply water to the first tub 14 or the second tub 24, and output a washing operation signal to the first driver 140 or the second driver 140 to rotate the first drum 13 or the second drum 23 according to the laundry course.

Furthermore, the first and second processors 111*a* and 111*b* may output a water drain signal to the drain system to drain water contained in the first tub 14 or the second tub 24, and output a dehydration driving signal to the first driver 140 or the second driver 140 to rotate the first drum 13 or the second drum 23 based on the dehydration level.

Moreover, the first and second processors 111*a* and 111*b* may output a heating signal to the heater 150 to heat the water contained in the first tub 14 or the second tub 24 until the temperature of the water reaches a set temperature set by the user.

Although a pair of the first and second processors 111*a* and 111*b* and a pair of the first and second memories 112*a* and 112*b* are shown in FIG. 5, the number of the processors and the number of memories are not limited thereto.

The controller 110 may include a plurality of processors and a plurality of memories. For example, the controller 110 may include the first memory for storing the program and data for controlling the first washing device 10, the first processor 111*a* for creating control signals to control the first washing device 10 based on the user's input through the first section SE1 of the control panel 90, the second memory for storing the program and data to control the second washing device 20, and the second processor 111*b* for creating control signals to control the second washing device 20 based on the user's input through the second section SE2 of the control panel 90. The first and second processors 111*a* and 111*b* may communicate with each other.

The controller 110 controls operations of the first and second washing devices 10 and 20.

In this way, the controller 110 may enable a washing course, a rinsing course, and a dehydrating course to be performed by controlling the water supplier 71, the drain system 50, the first driver 130, the second driver 140, and the heater 150 included in the washing machine 1 based on the user's input through the control panel 90 and the output of the temperature detector 120.

It may be seen that operation of the washing machine 1, as will be described below, may be performed under the control of the controller 110.

Figure 7:
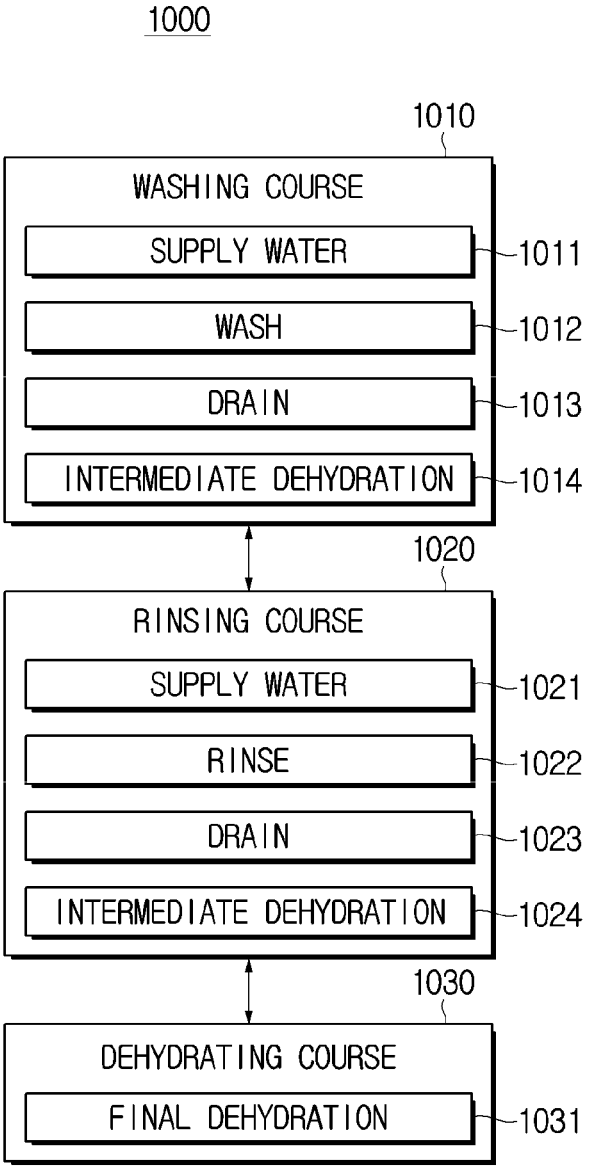
FIG. 7 shows an example of operation of a washing machine, according to an embodiment of the present disclosure.
Figure 8:
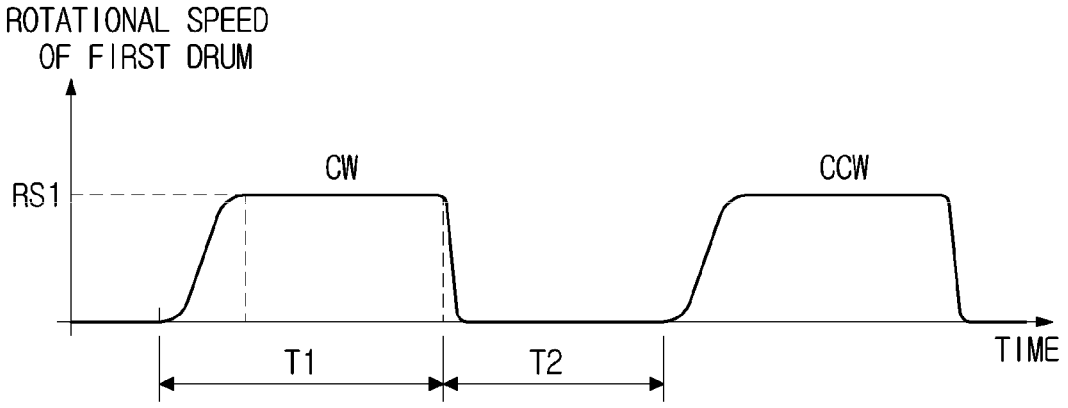
FIG. 8 shows an example of operation of a first drum during washing of the washing machine shown in FIG. 7.
Figure 9:
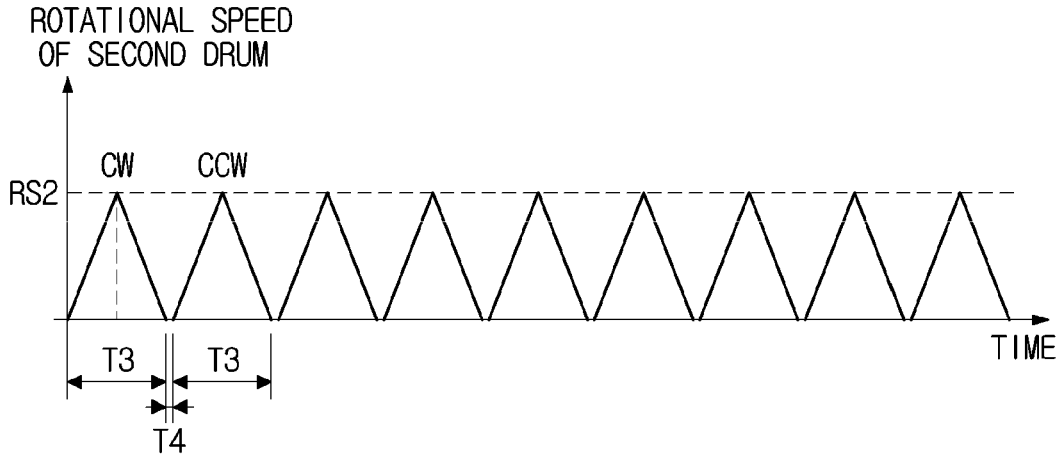
FIG. 9 shows an example of operation of a second drum during washing of the washing machine shown in FIG. 7.
Figure 10:
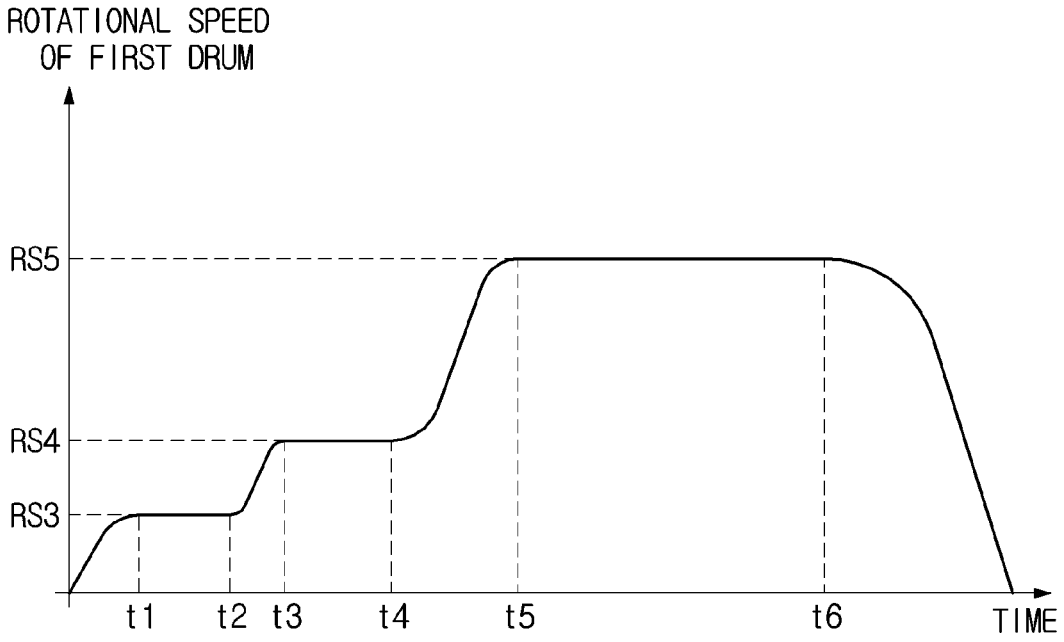
FIG. 10 shows an example of operation of the first drum during dehydration of the washing machine shown in FIG. 7.

FIG. 7 shows an example of operation of a washing machine, according to an embodiment of the present disclosure, FIG. 8 shows an example of operation of a first drum during washing of the washing machine shown in FIG. 7, FIG. 9 shows an example of operation of a second drum during washing of the washing machine shown in FIG. 7, and FIG. 10 shows an example of operation of the first drum during dehydration of the washing machine shown in FIG. 7.

Referring to FIGS. 7 to 10, operation 1000 of the washing machine 1 will be briefly described.

The washing machine 1 may perform a washing course 1010, a rinsing course 1020 and a dehydrating course 1030 in sequence under a control instruction of the controller 110 based on the user's input.

The first and second washing devices 10 and 20 may independently perform the washing course 1010, rinsing course 1020, and a dehydrating course 1030.

The washing course 1010 is a course to remove foreign materials from the laundry by a chemical action of a detergent and/or a mechanical action such as friction.

The washing course 1010 may include supplying of water 1011 that supplies water to the first tub 14 and/or the second tub 24, washing 1012 that washes the laundry by spinning the first drum 13 and/or the second drum 23, draining of water 1013 that drains water contained in the first tub 14 and/or the second tub 24, and intermediate dehydration 1014 that separates water from the laundry by spinning the first drum 13 and/or the second drum 23.

During the supplying of water, a detergent may be added into the first tub 14 and/or the second tub 24 along with the water.

The controller 110 may control the water supplier 71 to supply water to the first tub 14 when the first washing device 10 starts operating, and control the water supplier 71 to supply water to the second tub 24 when the second washing device 20 starts operating.

The controller 110 may enable the first washing device 10 to do the laundry in the front-loading type by using falling or rolling of the laundry from rotation of the first drum 13.

For this, during the washing 1012 of the first washing device 10, the controller 110 may control the first driver 130 to rotate the first drum 13 clockwise or counterclockwise. At this time, the controller 110 may output a speed instruction for the first drum 13 to the first driver 130.

In controlling the washing course of the first washing device 10, the controller 110 may control the first driver 130 to repeat alternate rotation of the first drum 13 clockwise and counterclockwise.

As shown in FIG. 8, the controller 110 controls the first driver 130 to rotate the first drum 13 clockwise (CW) for a first period of time (T1).

When the first drum that is rotating clockwise reaches a first rotational speed (RS1), the controller 110 controls the first driver 130 to maintain the first drum 13 to be rotated at the first rotational speed RS1, and after the lapse of the first period of time T1 of the clockwise rotation, the controller 110 controls the first driver 130 to stop rotation of the first drum 13 for a second period of time T2.

The first rotational speed RS1 may be about 45 revolution per minutes (rpm) to 60 rpm.

The controller 110 controls the first driver 130 to rotate the first drum 13 counterclockwise (CCW) for the first period of time (T1).

When the first drum that is rotating counterclockwise reaches the first rotational speed (RS1), the controller 110 controls the first driver 130 to maintain the first drum 13 to be rotated at the first rotational speed RS1, and after the lapse of the first period of time T1 of the counterclockwise rotation, the controller 110 controls the first driver 130 to stop rotation of the first drum 13 for the second period of time T2.

During the washing 1012 of the second washing device 20, the controller 110 may control the second driver 140 to rotate the second drum 23 clockwise or counterclockwise. At this time, the controller 110 may output a speed instruction for the second drum 23 to the second driver 140.

In controlling the washing course of the second washing device 20, the controller 110 may control the second driver 140 to repeat alternate rotation of the second drum 23 clockwise and counterclockwise.

The controller 110 may enable the second washing device 20 to do the laundry in the top-loading type by using water streams inside the second drum 23 from rotation of the second drum 23.

As shown in FIG. 9, the controller 110 may control the second driver 140 to rotate the second drum 23 clockwise (CW) for a third period of time (T3).

The controller 110 may control the second driver 140 to reduce the rotational speed of the second drum 23 when the second drum 23 that is rotating clockwise reaches second rotational speed RS2, and control the second driver 140 to stop rotation of the second drum 24 for a fourth period of time T4 when the rotational speed of the second drum 23 becomes zero.

The third period of time T3 for which the second drum 23 is rotated may be shorter than the first period of time T1 for which the first drum 13 is rotated. The controller 110 may control the third period of time T3 to be shorter so as to increase the force of the water streams inside the first drum 23.

The fourth period of time T4 for which rotation of the second drum 23 is stopped may be shorter than the second period of time T2 for which the rotation of the first drum 23 is stopped.

The controller 110 may control the second driver 140 to rotate the second drum 23 counterclockwise (CCW) for the third period of time (T3).

The controller 110 may control the second driver 140 to reduce the rotational speed of the second drum 23 when the second drum 23 that is rotating counterclockwise reaches the second rotational speed RS2, and control the second driver 140 to stop rotation of the second drum 24 for the fourth period of time T4 when the rotational speed of the second drum 23 becomes zero.

During the draining of water 1013, the controller 110 may control the first drain pump 51 to drain the water contained in the first tub 14 if the first washing device 10 is operating, and control the second drain pump 56 to drain the water contained in the second tub 24 if the second washing device 20 is operating.

During the intermediate dehydration 1014, the controller 1014 may control the first driver 130 to rotate the first drum 13 at high speed if the first washing device 10 is operating, and control the second driver 140 to rotate the second drum 23 at high speed if the second washing device 20 is operating.

The controller 110 may output a speed instruction for the first drum 13 to the first driver 130 during the intermediate dehydration of the first washing device 10, and may output a speed instruction for the second drum 23 to the second driver 140 during the intermediate dehydration of the second washing device 20.

The high-speed rotation of the first drum 13 may enable water to be separated from the laundry contained in the first drum 13 and discharged out of the washing machine 1, and the high-speed rotation of the second drum 23 may enable water to be separated from the laundry contained in the second drum 23 and discharged out of the washing machine 1.

As shown in FIG. 10, the controller 110 may control the first driver 130 to increase the rotational speed of the first drum 13 stepwise during the intermediate dehydration.

Specifically, the controller 110 may increase the rotational speed of the first drum 13 to third rotational speed RS3, maintain the rotational speed of the first drum 13 at the third rotational speed RS3 from a first point of time t1 when the rotational speed of the first drum 13 reaches the third rotational speed RS3 to a second point of time t2, increase the rotational speed of the first drum 13 to fourth rotational speed RS4 from the second point t2, and maintain the rotational speed of the first drum 13 at the fourth rotational speed RS4 from a third point of time t3 when the rotational speed of the first drum 13 reaches the fourth rotational speed RS4 to a fourth point of time t4.

The controller 110 may increase the rotational speed of the first drum 13 to fifth rotational speed RS5 from the fourth point t4, maintain the rotational speed of the first drum 13 at the fifth rotational speed RS5 from a fifth point of time t5 when the rotational speed of the first drum 13 reaches the fifth rotational speed RS5 to a sixth point of time t6, and reduce the rotational speed of the first drum 13 from the sixth point t6.

The third rotational speed RS3 and the fourth rotational speed RS4 may be a few hundred rpm, and the fourth rotational speed RS4 may be greater than the third rotational speed RS3. The fifth rotational speed RS5 may be around a thousand rpm, and may be greater than the fourth rotational speed RS4 and the third rotational speed RS3.

In this way, by increasing the rotational speed of the first drum 13 stepwise during the intermediate dehydration 1014, vibrations of the first drum 13 and the first tub 14 from unbalanced laundry inside the first drum 13 may be damped.

When the intermediate dehydration 1014 is completed, the washing course 1010 is finished and the rinsing course 1020 may begin.

The rinsing course 1020 may be a course to wash away the detergent or stain left on the laundry by friction with water.

The rinsing course 1020 may include supplying of water 1021 that supplies water to the first tub 14 and/or the second tub 24, rinsing 1022 that rinses the laundry by spinning the first drum 13 and/or the second drum 23, draining of water 1023 that drains water contained in the first tub 14 and/or the second tub 24, and intermediate dehydration 1024 that separates water from the laundry by spinning the first drum 13 and/or the second drum 23.

The supplying of water 1021, the rinsing 1022, the draining of water 1023, and the intermediate dehydration 1024 of the rinsing course 1020 are similar to the supplying of water 1011, the washing 1012, the draining of water 1013, and the intermediate dehydration 1014 of the washing course 1010. However, unlike the washing course 1010, no detergent but a fabric softener may be supplied to the first drum 13 and/or the second drum 23 in the rinsing course 1020.

Furthermore, the washing course 1010 is performed one time, but the rinsing course 1020 may be performed several times. For example, the supplying of water 1021, the rinsing 1022, the draining of water 1023, and the intermediate dehydration 1024 of the rinsing course 1020 may be repeated several times.

The dehydrating course 1030 is a course to separate water from the laundry and discharge the separated water to the outside.

The dehydrating course 1030 may include a final dehydration 1031 to separate water from the laundry by spinning the first drum 13 and/or the second drum 23.

During the final dehydration 1031, the controller 1014 may control the first driver 130 and/or the second driver 140 to rotate the first drum 13 and/or the second drum 23 at high speed. As the first driver 130 and/or the second driver 140 operate, rotational speeds of the first drum 13 and/or the second drum 23 may be increased stepwise.

Figure 11:
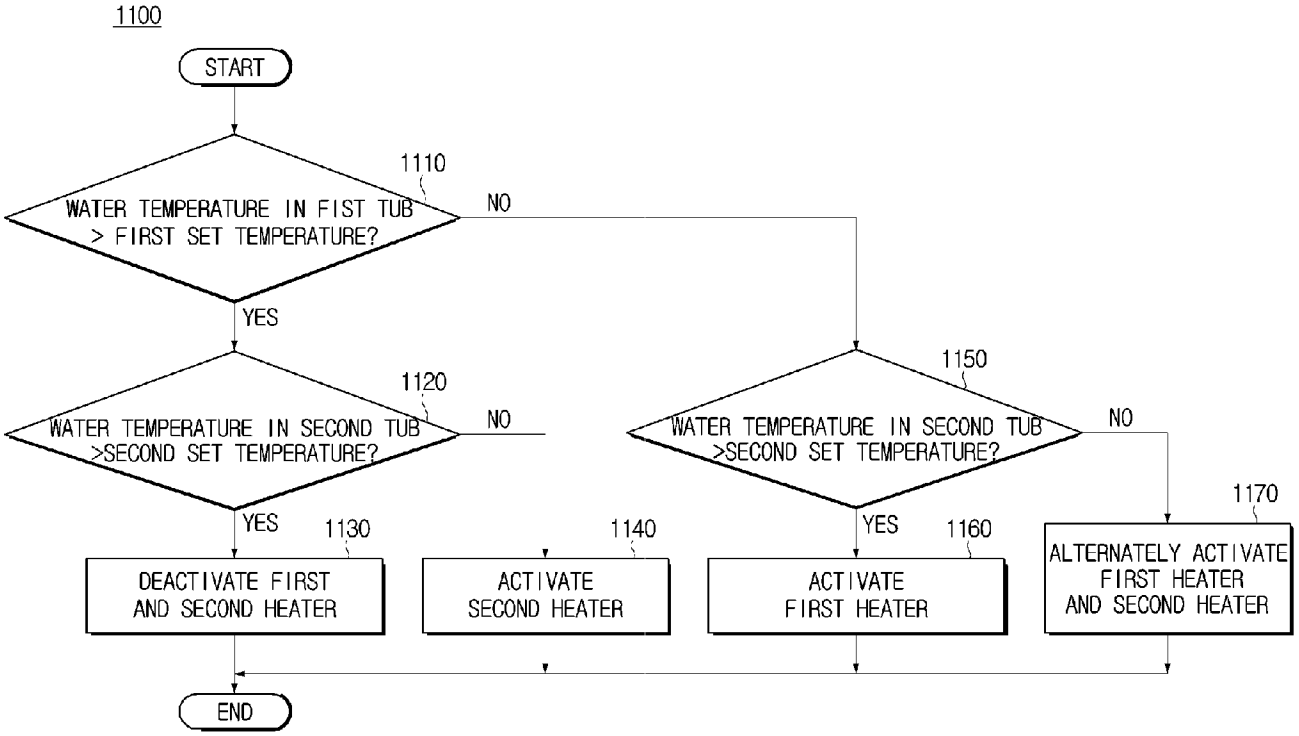
FIG. 11 shows an example of water heating operation of a washing machine, according to an embodiment of the present disclosure.
Figure 12:
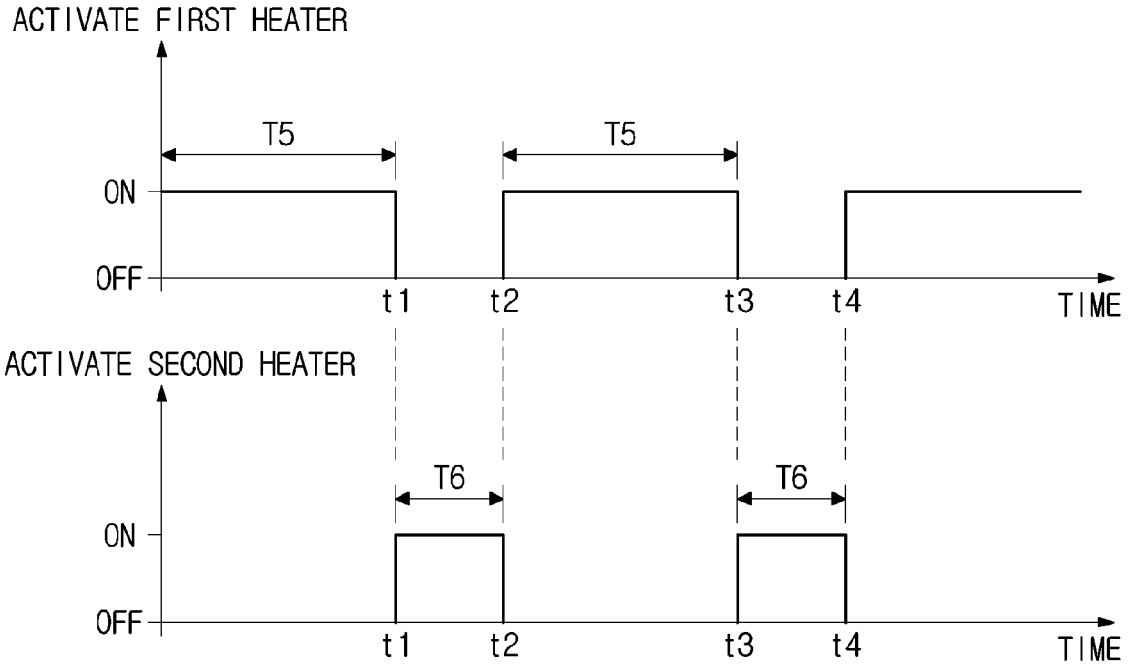
FIG. 12 shows an example of operation of a heater according to the water heating operation of the washing machine shown in FIG. 11.

Since the operation of the washing machine 1 is completed by the final dehydration 1031, time for which the final dehydration 1031 is performed may be longer than the time for which the intermediate dehydration 1014 or 1024 is performed FIG. 11 shows an example of water heating operation of a washing machine, according to an embodiment of the present disclosure. FIG. 12 shows an example of operation of a heater according to the water heating operation of the washing machine shown in FIG. 11.

The user may set a temperature of water to be used in washing and/or rinsing through the control panel 90. As shown in FIG. 5, the user may set the temperature of water to be used in washing or rinsing with the details setting buttons S1 and S2 of the control panel 90.

Specifically, before operation of the washing machine 1, the control panel 90 may receive an input of a temperature (a first set temperature) of the water (for washing or rinsing) involved in laundry of the first washing device 10 from the user, and receive an input of a temperature (a second set temperature) of the water (for washing or rinsing) involved in laundry of the second washing device 20 from the user.

The washing machine 1 may heat the water for washing or rinsing by activating the heater 150 based on the set temperature input through the control panel 90.

Referring to FIGS. 11 and 12, water heating operation 1100 of the washing machine 1 during a washing course or rinsing course in a case that both the first and second washing devices 10 and 20 are activated will be described.

During the washing course or the rinsing course, the washing machine 1 may use the first temperature sensor 121 to measure the temperature (first measured temperature) of water contained in the first tub 14, and determine whether the measured temperature of water in the first tub 14 is higher than the first set temperature set by the user, in 1110.

Specifically, the washing machine 1 may determine if the first measured temperature is higher than the first set temperature by comparing the first measured temperature received from the first temperature sensor 121 with the first set temperature stored in the first and second memories 112*a* and 112*b*.

If the temperature of the water contained in the first tub 14 is higher than the first set temperature set by the user in 1110, the washing machine 1 determines whether the temperature of water contained in the second tub 24 is higher than the second set temperature set by the user, in 1120.

Specifically, the washing machine 1 may use the second temperature sensor 122 installed in the second tub 24 to measure the temperature (second measured temperature) of the water contained in the second tub 24, and determine if the second measured temperature is higher than the second set temperature by comparing the second measured temperature with the second set temperature stored in the first and second memories 112*a* and 112*b*.

If the temperature of the water contained in the second tub 24 is higher than the second set temperature set by the user in 1120, the washing machine 1 deactivates the first heater 18 and the second heater 28 in 1130.

Furthermore, if the user may set the temperature of water involved with laundry of the first washing device 10 to 'cold water' and the temperature of water involved with laundry of the second washing device 20 to 'cold water' through the control panel 90, the washing machine 1 may deactivate the first heater 18 and the second heater 28.

If the temperature of the water contained in the second tub 24 is not higher than the second set temperature set by the user in 1120, the washing machine 1 activates the second heater 28, in 1140.

In other words, since the temperature of the water contained in the first tub 14 is higher than the first set temperature but the temperature of the water contained in the second tub 24 has not yet reached the second set temperature, the washing machine 1 may keep on activating the second heater 28 to heat the water contained in the second tub 24.

If the temperature of the water contained in the first tub 14 is not higher than the first set temperature set by the user in 1110, the washing machine 1 determines whether the temperature of water contained in the second tub 24 is higher than the second set temperature set by the user, in 1150.

The washing machine 1 may determine whether the second measured temperature is higher than the second set temperature by comparing the second set temperature set by the user and the second measured temperature measured by the second temperature sensor 122.

If the temperature of the water contained in the second tub 24 is higher than the second set temperature set by the user in 1150, the washing machine 1 activates the first heater 18, in 1160.

In other words, since the temperature of the water contained in the second tub 24 is higher than the second set temperature but the temperature of the water contained in the first tub 14 has not yet reached the first set temperature, the washing machine 2 may keep on activating the first heater 18 to heat the water contained in the first tub 14.

If the temperature of the water contained in the second tub 24 is not higher than the second set temperature set by the user in 1150, the washing machine 1 activates the first heater 18 and the second heater 28, in 1170.

In other words, since the temperature of the water contained in the first tub 14 and the temperature of the water contained in the second tub 24 have not yet reached the first and second set temperatures, respectively, the washing machine 1 may keep on activating the first and second heaters 18 and 28 to heat the water contained in the first and second tubs 14 and 24.

To prevent a rapid increase in power consumption of the washing machine 1 in case that the first and second heaters 18 and 28 are activated simultaneously, the washing machine 1 may alternately activate the first heater 18 and the second heater 28, in 1170.

As shown in FIG. 12, the washing machine 1 may control the first heater 18 to be activated for a fifth time T5, and control the first heater 18 to stop being activated after the lapse of the fifth time T5, and may control the second heater 28 to be activated for a sixth time T6, and control the second heater 28 to stop being activated and start activating the first heater 18 after the lapse of the sixth time T6.

Operation of the first and second processors of the controller 110 equipped in the washing machine 1 in this regard will now be briefly described.

The first processor 111*a* may output a first heating signal to activate the first heater 18 to the first heater 18. When the activation time of the first heater 18 reaches the fifth time T5, the first processor 111*a* may stop outputting the first heating signal and send a signal indicating that the first heater 18 stops being activated to the second processor 111*b*.

In response to the signal indicating that the first heater 18 stops being activated, the second processor 111*b* may output a second heating signal to activate the second heater 28 to the second heater 28. When the activation time of the second heater 28 reaches the sixth time T6, the second processor 111*b* may stop outputting the second heating signal and send a signal indicating that the second heater 28 stops being activated to the first processor 111*a*.

In response to the signal indicating that the second heater 28 stops being activated, the first processor 111*a* may output the first heating signal to activate the first heater 18 to the first heater 18.

Figure 13:
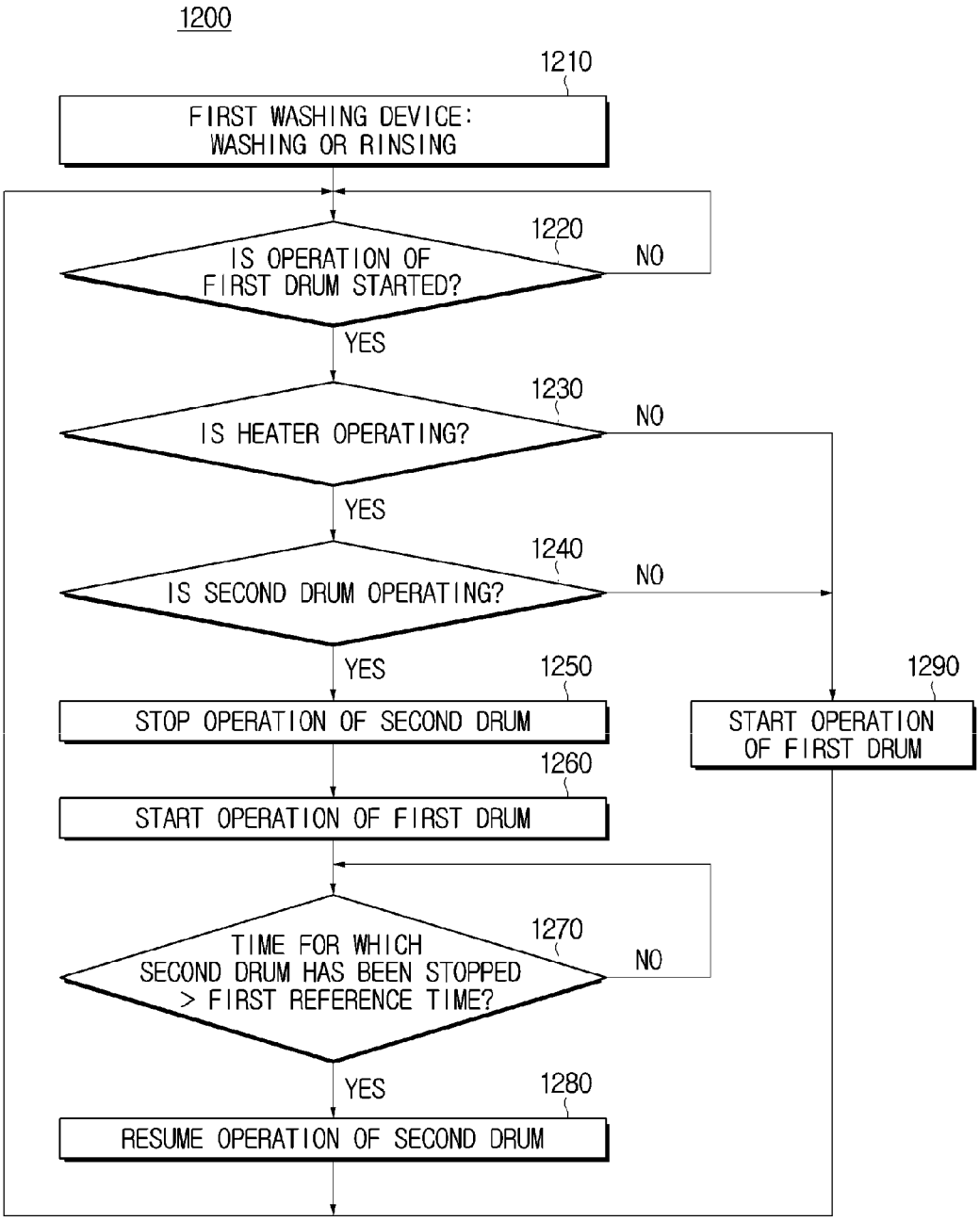
FIG. 13 shows an example of operation of a washing machine, according to an embodiment of the present disclosure.
Figure 14:
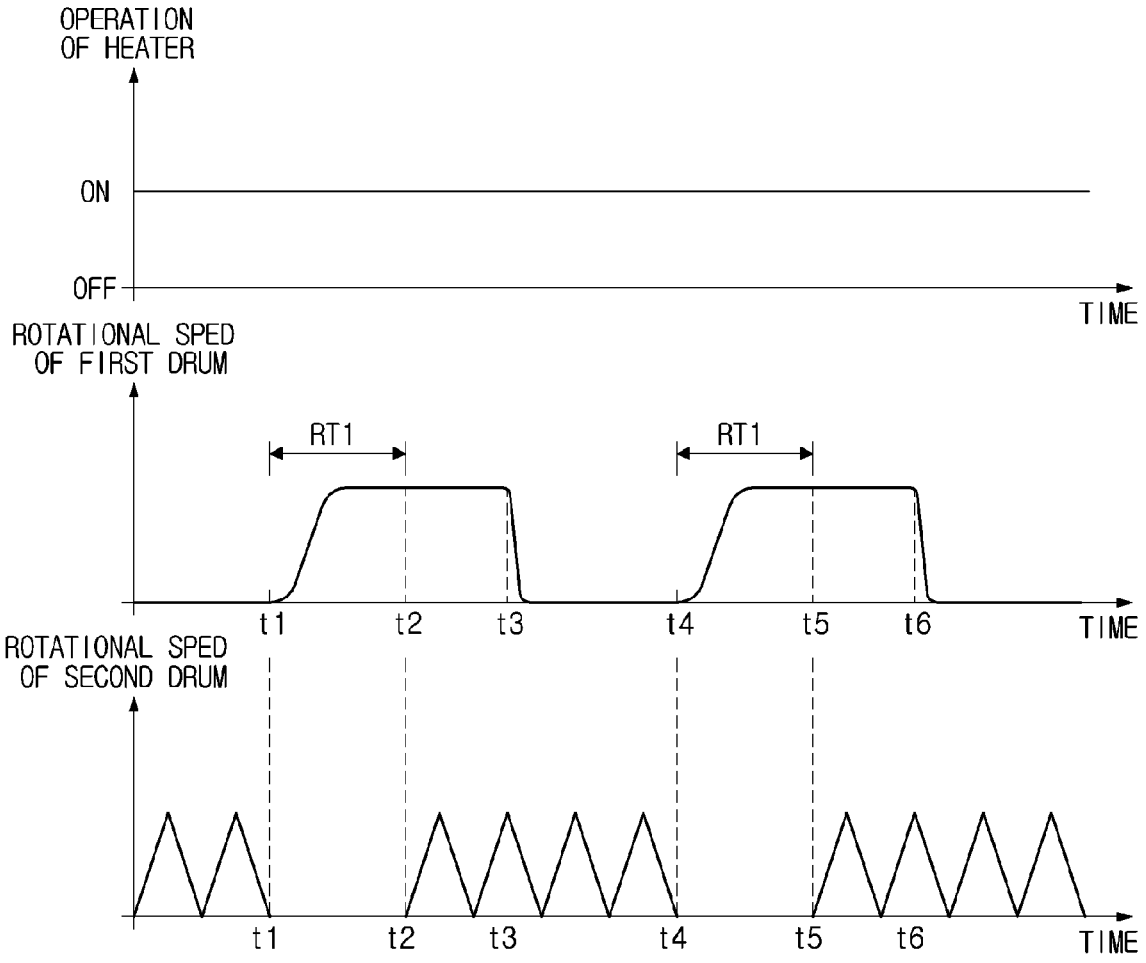
FIG. 14 shows an example of operation of a heater and operation of a drum according to operation of the washing machine shown in FIG. 13.

FIG. 13 shows an example of operation of a washing machine, according to an embodiment of the present disclosure, and FIG. 14 shows an example of operation of a heater and operation of a drum according to operation of the washing machine shown in FIG. 13.

Referring to FIGS. 13 and 14, operation 1200 of the washing machine 1 during washing or rinsing of the first washing device 10 and the second washing device 20 will be described.

Upon reception of a command to operate the first washing device 10 through the control panel 90, the washing machine 1 performs washing and rinsing courses of the first washing device 10 in sequence.

The washing machine 1 determines whether the first drum 13 starts operating while performing one of a washing course and a rinsing course, in 1220.

In other words, the washing machine 1 may determine to start operating the first drum 13 when the time for which operation of the first drum 13 has been stopped reaches the second time T2 (see FIG. 8) during washing.

Furthermore, the washing machine 1 may also determine when to start operating the first drum 13. For example, the washing machine 1 may determine a point at which water supply has been completed and a certain time has elapsed to be a starting point to start operating of the first drum 13, or alternatively, the washing machine 1 may determine a point at which time for which operation of the first drum 13 has been stopped reaches the second time to be a starting point to start operation of the first drum 13.

If it is not determined to start operation of the first drum 13 in 1220, the washing machine 1 may continue to do the on-going operation.

If it is determined to start operation of the first drum 13 in 1220, the washing machine 1 determines whether the heater 150 is operating, in 1230.

Furthermore, if determining that it is time to start operation of the first drum 13, the washing machine 1 may determine whether the heater 150 is operating, at a point a predetermined time before the starting point to start operation of the first drum 13.

Determining whether the heater 150 is operating may include determining whether at least one of the first heater 18 and the second heater 28 is operating based on whether the controller 110 outputs the first heating signal and/or the second heating signal.

If it is determined that the heater 150 is not operating in 1230, the washing machine 1 operates the first drum 13, in 1290. Operating the first drum may include outputting the first speed instruction to the first driving circuit 131.

If it is determined that the heater 150 is operating in 1230, the washing machine 1 determines whether the second drum 23 is operating in 1240, before starting to operate the first drum 13.

Determining whether the second drum is operating may include determining whether the second drum 23 is operating based on whether the controller 110 outputs the second speed instruction.

If it is determined that the second drum 23 is not operating in 1240, the washing machine 1 operates the first drum 13, in 1290.

If it is determined that the second drum 23 is operating for washing or rinsing in 1240, the washing machine 1 stops operation of the second drum 23 and starts operation of the first drum 13, in 1260.

Stopping operation of the second drum 23 may include stopping outputting the second speed instruction to the second driver 140 or outputting the second speed instruction of '0 rpm' to the second driver 140.

As shown in FIG. 14, the washing machine 1 may determine whether the second drum 23 is operating if it is determined that the heater 150 is activated at the first point of time t1, and if the second drum 23 is operating at the first point of time t1, may stop operation of the second drum 23 and start operation of the first drum 13. In this way, a rapid increase in power consumption when the first drum 13 starts being operated while the heater 150 is activated and the second drum 23 is operating may be prevented.

Configurations in this regard will be described in more detail by referring to an operation pattern of the first washing device 10 and an operation pattern of the second washing device 20.

The first washing device 10 may rotate the first drum 13 for about 20 seconds during washing or rinsing and then stop the first drum 13 for about 4 to 5 seconds. In comparison, the second washing device 20 may rotate the second drum 23 for about 3 to 5 seconds during washing or rinsing and then stop the second drum 23 for about 1 second. In other words, the second drum 23 operates for shorter time but more often than the first drum 13.

Accordingly, if operation of the first drum 13 is stopped while the second drum 23 is operating, the first drum 13 may be operated after washing or rinsing of the second washing device 20 is completed. On the contrary, if operation of the second drum 23 is stopped while the first drum 13 is operating, the second drum 23 may be operated at least while the first drum 13 is stopped.

Accordingly, if the heater 150, the first driver 130, and the second driver 140 are all operating, the washing machine 1 may stop operation of the second driver 140 of the second washing device 20 for efficient operation of the first washing device 10 and the second washing device 20.

The washing machine 1 may count time for which operation of the second drum 23 has been stopped since the operation of the second drum 23 was stopped, compare the counted time for which the second drum 23 has been stopped and a first reference time RT1, and determine if the counted time is longer than the first reference time RT1, in 1270.

The first reference time RT1 may be shorter than an operation time of the first drum, which is about 20 seconds.

In other words, the second drum 23 may be operated before operation of the first drum 13 is stopped.

If the time for which operation of the second drum 23 has been stopped is not equal to or longer than the first reference time RT1 in 1270, the washing machine 1 may continue to count the time for which operation of the second drum 23 has been stopped.

If the time for which operation of the second drum 23 has been stopped is equal to or longer than the first reference time RT1 in 1270, the washing machine 1 may resume operation of the second drum 23, in 1280.

In other words, the washing machine 1 may control the second driver 140 to rotate the second drum 23 if the elapsed time after the first drum 13 starts operation is equal to or longer than the first reference time RT1.

As shown in FIG. 14, the washing machine may operate the second drum 23 again at the second point t2 at which the time for which operation of the second drum 23 has been stopped reaches the first reference time RT1 or more.

In this way, the washing machine 1 may prevent the sum of a current of the heater 150, the first driving current of the first driving motor 40, and the second driving current of the second driving motor 45 from exceeding a predetermined upper limit at a point of time to start driving the first driving motor 40 by stopping operation of the second driving motor 45 at the point of time to start the first driving motor 40 taking into account that a greater driving current is consumed when the driving motors 40 and 45 increase in speed than when they remain at constant rotational speed.

In other words, to prevent a rapid increase in power consumption of the washing machine 1 while the rotation speed of the first driving motor 40 is increasing, the washing machine 1 may stop operation of the second driving motor 45.

On the contrary, while the first driving motor 40 remains at a constant rotational speed, the washing machine 1 may allow operation of the second driving motor 45, thereby improving laundry efficiency of the second washing device 20.

After this, the washing machine 1 determines whether a time for which the first drum 13 has been operated is longer than the first time T1 (see FIG. 6), and stops operation of the first drum 13 if the time for which the first drum 13 has been operated is longer than the first time T1.

After that, the washing machine determines whether to start operation of the first drum 13 again, in 1220.

A configuration in which operation of the second driving motor 45 is temporarily stopped when operation of the first driving motor 40 has to be started while the heater 150 and the second driving motor 45 is operating has thus far been described.

Another example for preventing simultaneous operation of the first and second driving motors and the heater will now be briefly described.

In another example, the washing machine 1 may delay operation of the second driving motor 45 until the operation of the first driving motor 40 is stopped if determining that operation of the second driving motor 45 needs to be started while the heater 150 and the first driving motor 40 is operating, and operate the second driving motor 45 after the operation of the first driving motor 40 is stopped.

In yet another example, the washing machine 1 may stop operation of the heater 150 if the heater 150 and the driving motors 40 and 45 are operating at the same time. Specifically, if determining that the first drum 13 needs to be operated for washing or rinsing, the washing machine 1 may determine whether the heater 150 and the second drum 23 are operating before driving the first drum 13, and if the heater 150 and the second drum 23 are operating, may stop operation of the heater 150 and start operation of the first drum 13, and may resume operation of the heater 150 if a time for which the operation of the heater 150 has been stopped is longer than the first reference time RT1.

In another example, while the heater 150 and the second driver 140 are operating, the washing machine 1 may stop operation of the second driver 140 if the first speed instruction output to the first driver 130 is higher than a predetermined reference speed. The predetermined reference speed may be e.g., 1 rpm.

Figure 15:
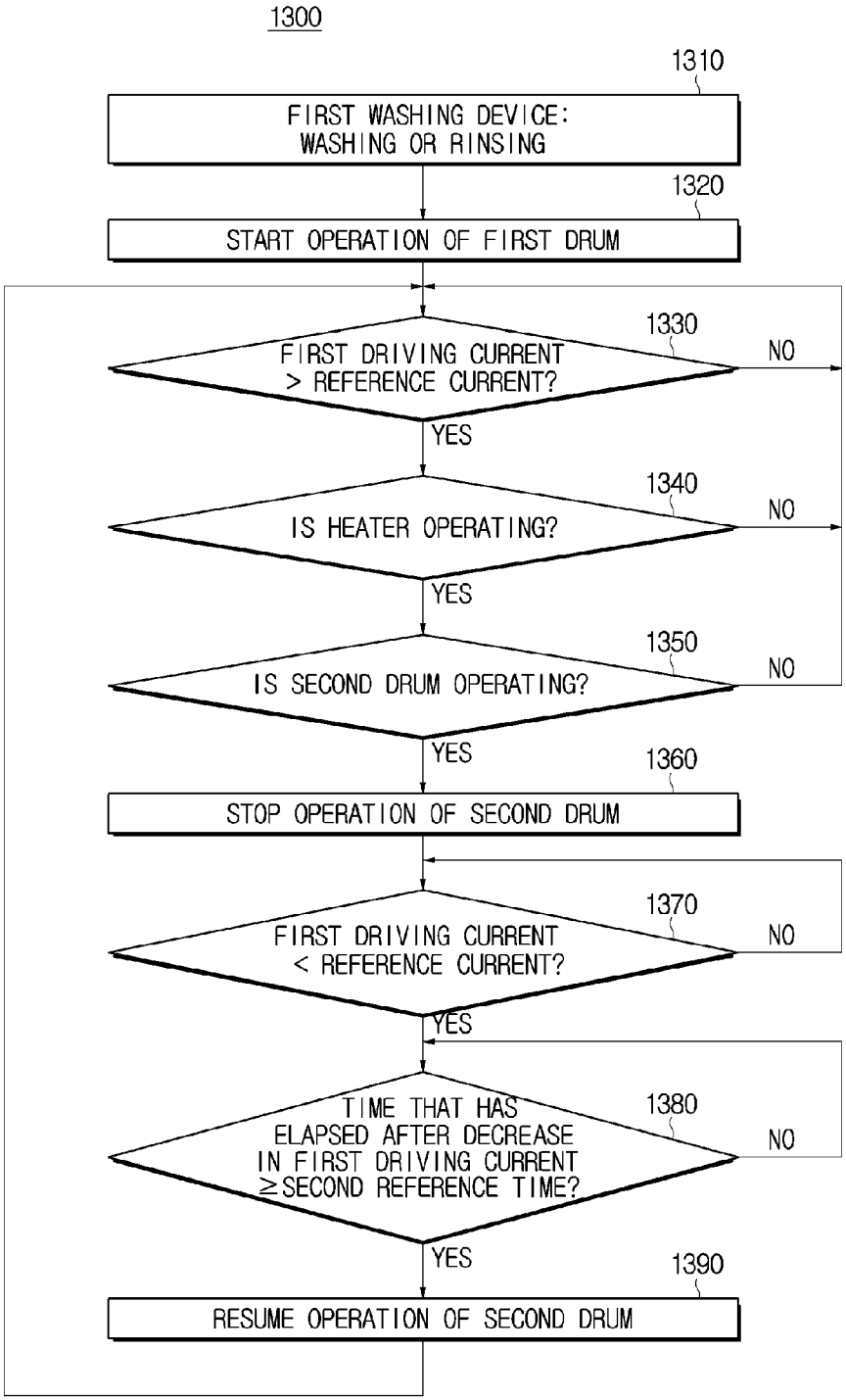
FIG. 15 is a flowchart illustrating operation of a washing machine, according to an embodiment of the present disclosure.
Figure 16:
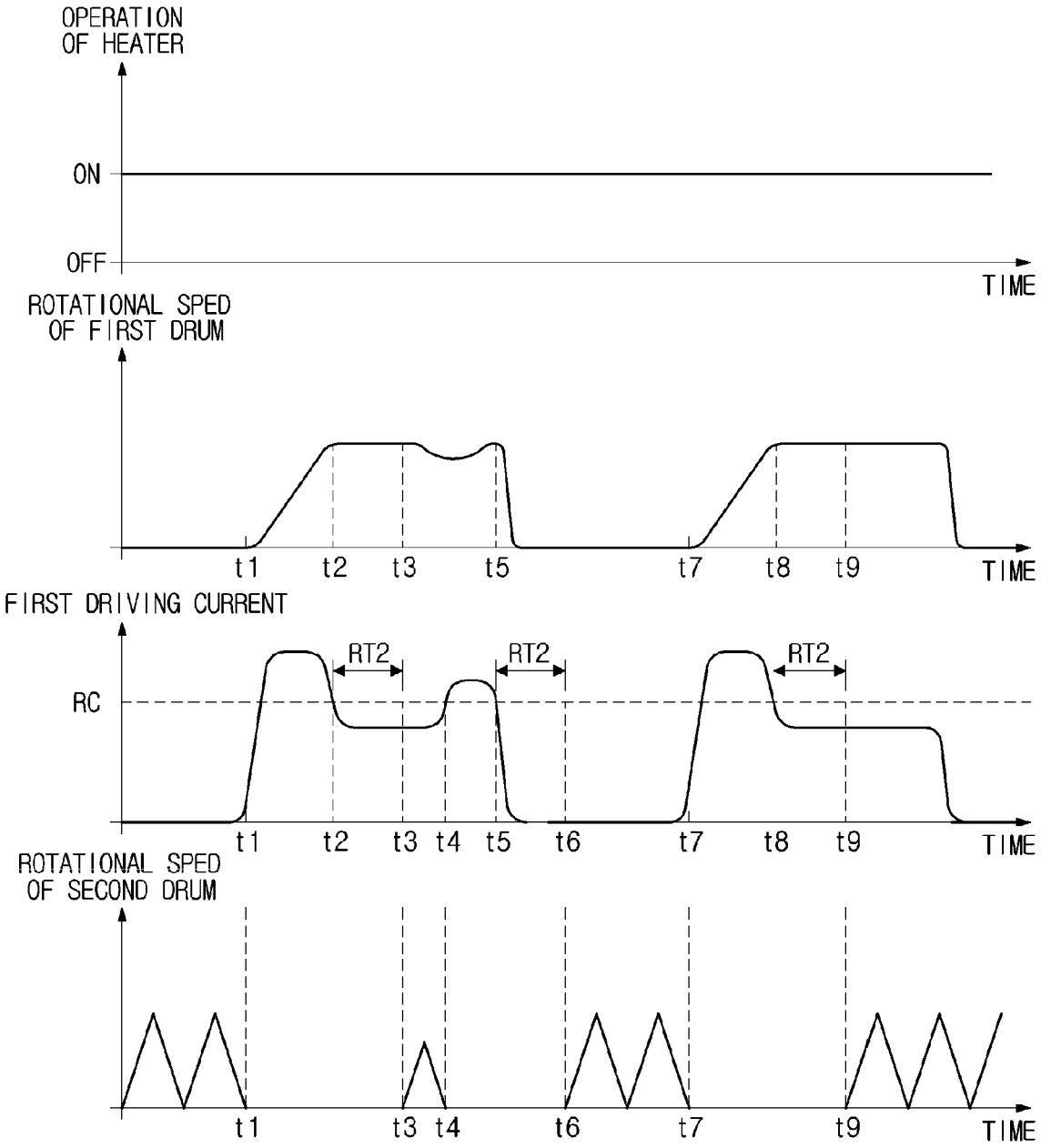
FIG. 16 shows an example of operation of a heater and operation of a drum according to operation of the washing machine shown in FIG. 15.

FIG. 15 shows another example of operation of a washing machine, according to an embodiment of the present disclosure, and FIG. 16 shows an example of operation of a heater and operation of a drum according to operation of the washing machine shown in FIG. 15.

Referring to FIGS. 15 and 16, operation 1300 of the washing machine 1 during washing or rinsing of the first washing device 10 and the second washing device 20 will be described.

Upon reception of a command to start the first washing device 10 through the control panel 90, the washing machine 1 performs washing and rinsing courses of the first washing device 10 in sequence.

Specifically, the washing machine 1 starts operation of the first drum 13 while performing one of a washing course and a rinsing course, in 1320.

The washing machine measures the first driving current DC1 applied to the first driving motor 40 and determines whether the measured first driving current DC1 is greater than a predetermined reference current RC, in 1330.

The reference current RC is a value to avoid the sum of the current of the heater 150, the second driving current of the second driving motor 45, and the reference current RC of the second driving motor 45 from exceeding a predetermined upper limit. For example, the reference current RC may be set to 6 ampere (A).

If the first driving current DC1 is not greater than the reference current RC in 1330, the washing machine 1 may repeat comparing the first driving current DC1 and the reference current RC.

If the first driving current DC1 is greater than the reference current RC, in 1330, the washing machine 1 determines whether the heater 150 is operating, in 1340.

Operation 1340 may be the same as operation 1230.

If it is determined that the heater 150 is not operating in 1340, the washing machine 1 may repeat comparing the first driving current DC1 and the reference current RC and determining whether the heater 150 is operating.

If it is determined that the heater 150 is operating in 1340, the washing machine 1 determines whether the second drum 23 is operating for washing or rinsing in 1350.

Operation 1350 may be the same as operation 1240.

If it is determined that the heater 23 is not operating in 1350, the washing machine 1 may repeat comparing the first driving current DC1 and the reference current RC, determining whether the heater 150 is operating, and determining whether the second drum 23 is operating.

If it is determined that the second drum 23 is operating for washing or rinsing in 1350, the washing machine 1 stops operation of the second drum 23, in 1360.

In other words, to prevent the first driving current DC1 applied to the first drum 13 from exceeding the reference current RC while the heater 150 is being activated and the second drum 23 is operating, the washing machine 1 may stop operation of the second drum 23.

Stopping operation of the second drum 23 may include stopping outputting the second speed instruction to the second driver 140 or outputting the second speed instruction of '0 rpm' to the second driver 140.

As shown in FIG. 16, if it is determined that the first driving current DC1 exceeds the reference current RC at the first point of time t1, it is determined whether the heater 150 is being activated and the second drum 23 is operating, and if it is determined that the heater 150 is being activated and the second drum is operating at the first point of time t1, operation of the second drum 23 is stopped.

The reason why the first driving current DC1 exceeds the reference current RC at the first point of time t1 is that the first driving current DC1 greater than the reference current RC may have been applied to the first driving motor 40 to increase the rotational speed of the first driving motor.

As shown in FIG. 16, if it is determined that the first driving current DC1 exceeds the reference current RC at the fourth point of time t4, it is determined whether the heater 150 is being activated and the second drum 23 is operating at the fourth point of time t4, and if it is determined that the heater 150 is being activated and the second drum is operating at the fourth point of time t4, operation of the second drum 23 is stopped.

The reason why the first driving current DC1 exceeds the reference current RC at the fourth point of time t4 is that the first driving current DC1 greater than the reference current RC may have been applied to the first driving motor 40 to increase the rotational speed of the first drum because the rotation speed of the first drum 13 has decreased due to e.g., unbalanced distribution of the laundry in the first drum 13.

After this, the washing machine 1 measures the first driving current DC1 applied to the first driving motor 40 and determines whether the measured first driving current DC1 is smaller than the reference current RC, in 1370.

If the first driving current DC1 is not smaller than the reference current RC in 1370, the washing machine 1 may repeat comparing the first driving current DC1 and the reference current RC.

If the first driving current DC1 is smaller than the reference current RC in 1370, the washing machine 1 may determine whether a time that has elapsed since the first driving current DC1 became smaller than the reference current RC is longer than the second reference time RT2, in 1380.

The first driving current DC1 to be applied to the first driving motor 40 may vary by the load of the first driving motor 40. That is, for a short period of time after the first driving current DC1 becomes smaller than the reference current RC, the first driving current DC1 may increase more than the reference current RC. In other words, the first driving current DC1 may be changed to be unstable after it is smaller than the reference current RC.

Accordingly, the washing machine 1 may delay operation of the second drum 23 for a second reference time RT2 to stabilize the first driving current DC1 after the first driving current DC1 becomes smaller than the reference current RC. The second reference time RT2 to stabilize the first driving current DC1 may be about 1.2 seconds.

As shown in FIG. 16, the washing machine 1 may count time that elapses from the second point of time t2 if the first driving current DC1 becomes smaller than the reference current RC at the second point of time t2.

If the time that has elapsed since the first driving current DC1 became smaller than the reference current RC is longer than the second reference time RT2 1380, the washing machine resumes operation of the second drum 23, in 1390.

In other words, if the first driving current DC1 is stabilized after it becomes smaller than the reference current RC, it may be determined that the sum of the current applied to the hater 150 and the driving current of the driving motors 40 and 45 does not exceed the upper limit. Accordingly, the washing machine 1 may allow operation of the second driving motor 45 to improve laundry efficiency of the second washing device 20.

For this reason, the washing machine 1 may control the second driver 140 to rotate the second drum 23 if the elapsed time after the first driving current DC1 becomes smaller than the reference current RC is equal to or longer than the second reference time RT2.

As shown in FIG. 16, the washing machine 1 may control the second driver 140 to rotate the second drum 23 at a third point of time t3 at which the second reference time RT2 has elapsed from the second point of time t2.

After that, the washing machine 1 determines again whether the first driving current DC1 is greater than the reference current RC, in 1330.

As described above, if both the first and second washing devices 10 and 20 are performing washing or rinsing, the washing machine 1 may prevent the heater 150 and the driving motors 40 and 45 from being operated simultaneously.

Specifically, if the first driving current applied to the first driving motor 40 is greater than the reference current while the heater 150 and the second driving motor 45 is operating, the washing machine 1 may stop operation of the second driving motor 45 until the first driving current becomes smaller than the reference current.

As a result, the washing machine 1 may prevent a dramatic increase in power consumption.

Operation of the washing machine 1 to stop operation of one of the driving motors 40 and 45 if the driving current of the driving motors 40 and 45 exceeds a reference value has thus far been described. The operation of the washing machine 1 is not, however, limited thereto.

In another example, if the driving current of the driving motor 40 and 45 exceeds a reference value, the washing machine 1 may stop operation of the heater 150.

Specifically, the washing machine 1 may determine if the first driving current of the first driving motor 40 is greater than the reference value during washing or rinsing, determine if the heater 150 and the second drum 23 are operating if the first driving current is greater than the reference value, and stop operation of the heater 150 and operate the first drum 13 if the heater 150 and the second drum 23 are operating. In other words, the washing machine 1 may output a signal to stop heating to the heater 150 and output the first speed instruction to the first driver 130 to rotate the first drum 13, and may resume operation of the heater 150 if the elapsed time after the first driving current becomes smaller than the reference value is longer than the second reference time RT2.

In this way, the washing machine 1 may avoid a rapid increase in power consumption by preventing the heater 150, the first driver 130, and the second driver 140 from being operated simultaneously in order for the sum of the current applied to the hater 150, the first driving current DC1 of the first driving motor 40, and the second driving current of the second driving motor 45 not to exceed the predetermined upper limit.

Figure 17:
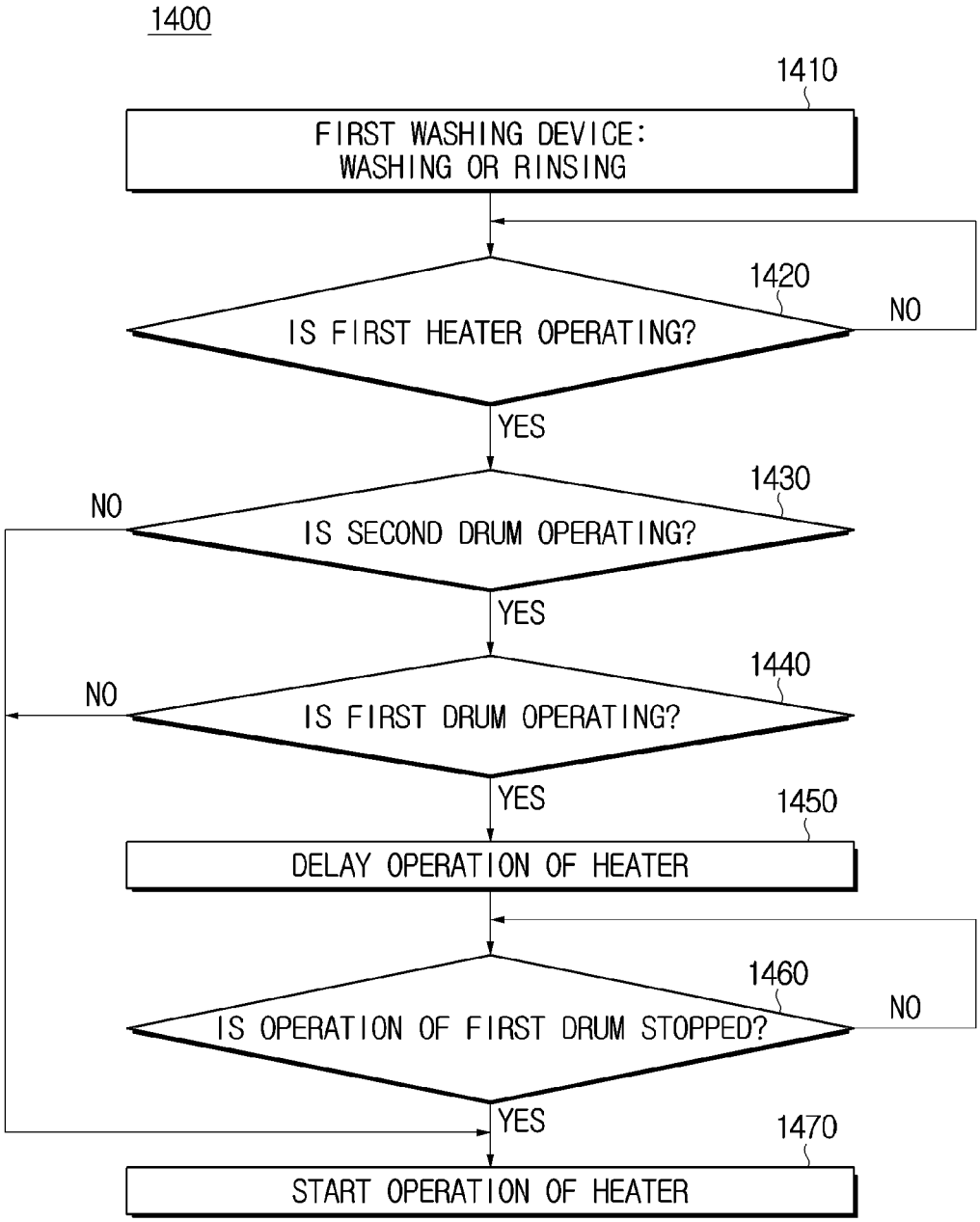
FIG. 17 is a flowchart illustrating operation of a washing machine, according to another embodiment of the present disclosure.
Figure 18:
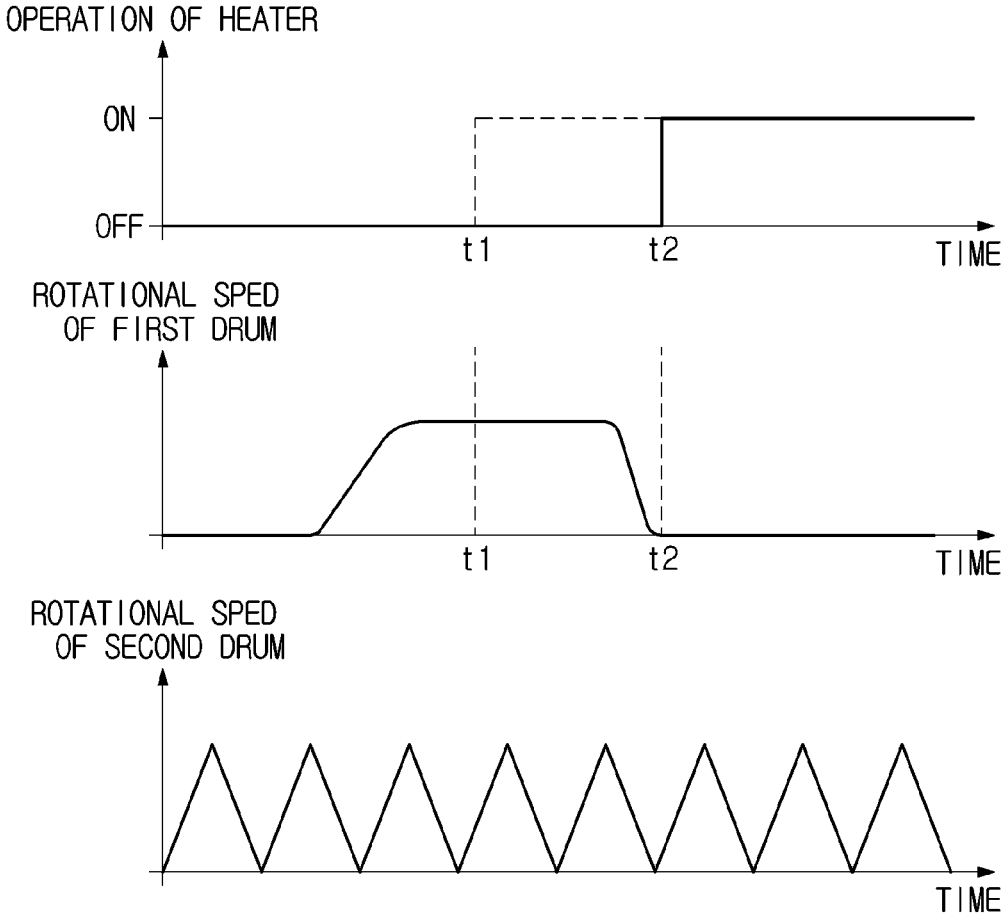
FIG. 18 shows an example of operation of a heater and operation of a drum according to operation of the washing machine shown in FIG. 17.

FIG. 17 shows another example of operation of a washing machine, according to an embodiment of the present disclosure, and FIG. 18 shows an example of operation of a heater and operation of a drum according to operation of the washing machine shown in FIG. 17.

Referring to FIGS. 17 and 18, operation 1400 of the washing machine 1 during washing or rinsing of the first washing device 10 and the second washing device 10 will be described.

Upon reception of a command to start the first washing device 10 through the control panel 90, the washing machine 1 performs washing and rinsing courses of the first washing device 10 in sequence.

Specifically, the washing machine 1 determines whether to activate the first heater 18 in 1410, after supplying water during one of washing and rinsing courses in 1340.

The washing machine 1 may use the first temperature sensor 121 installed in the first tub 14 to measure the temperature (the first measured temperature) of water contained in the first tub 14, and may activate the first heater 18 if the measured temperature of the water in the first tub 14 is lower than the first set temperature set by the user through the control panel 90.

If the first heater 18 is not activated in 1410, the washing machine 1 may perform washing or rinsing.

If it is determined that the heater 18 is activated in 1410, the washing machine 1 determines whether the second drum 23 is operating for washing or rinsing in 1430.

The washing machine 1 may determine if the second drum 23 is operating before activating the first heater 18 if the first measured temperature is lower than the first set temperature. Determining if the second drum is operating may include determining whether the second drum 23 is operating based on whether the second speed instruction for washing or rinsing is output.

If it is determined that the second drum 23 is not operating in 1430, the washing machine 1 operates the first heater 18, in 1470. At this time, the controller 110 of the washing machine 1 may output the first heating signal to the first heater 18.

If it is determined that the second drum 23 is operating in 1430, the washing machine 1 determines whether the first drum 13 is operating for washing or rinsing in 1440.

The washing machine 1 may determine if the first drum 13 is operating before activating the first heater 18 if the first measured temperature is lower than the first set temperature. Determining if the first drum is operating may include determining whether the first drum 13 is operating based on whether the first speed instruction for washing or rinsing is output.

If it is determined that the first drum 13 is not operating in 1440, the washing machine 1 operates the first heater 18, in 1470.

If it is determined that the first drum 13 is operating in 1440, the washing machine 1 delays operation of the first heater 18, in 1450.

As shown in FIG. 18, the washing machine 1 determines whether both the first drum 13 and the second drum 14 are operating at the first point of time t1 if determining that the first measured temperature is lower than the first set temperature at the first point of time t1, and delays operation of the first heater 18 if determining that both the first drum 13 and the second drum 14 are operating.

While the operation of the first heater 18 is delayed, the washing machine 1 determines whether the operation of the first drum 13 is stopped, in 1460.

While the operation of the first heater 18 is delayed, the washing machine 1 determines whether the operation of the first drum 13 is stopped.

Determining if operation of the first drum 13 is stopped may include determining if a time for which the first drum 13 has been operated is equal to or longer than the first time T1 (see FIG. 6).

If the operation of the first drum 13 is stopped in 1460, the washing machine 1 operates the first heater 18, in 1470. At this time, the controller 110 of the washing machine 1 may output the first heating signal to the first heater 18.

Subsequently, operation 1200 of the washing machine 1 as shown in FIG. 13 may be performed. Specifically, since the first heater 18 and the second drum 23 are operating, the washing machine 1 may stop operation of the second drum 23 before operating the first drum 13.

Although operation of the first heater 18 is described above, operation 1400 of the washing machine 1 may be equally applied to the second heater 28.

As described above, if both the first and second washing devices 10 and 20 are performing washing or rinsing, the washing machine 1 may prevent the heater 150 and the driving motors 40 and 45 from being operated simultaneously.

In other words, if operation of the heater 150 is to be started while both the first and second driving motors 40 and 45 are operating, the washing machine 1 may delay operation of the heater 150 until operation of one of the first and second driving motors 40 and 45 is stopped.

As a result, the washing machine 1 may prevent a dramatic increase in power consumption.

Figure 19:
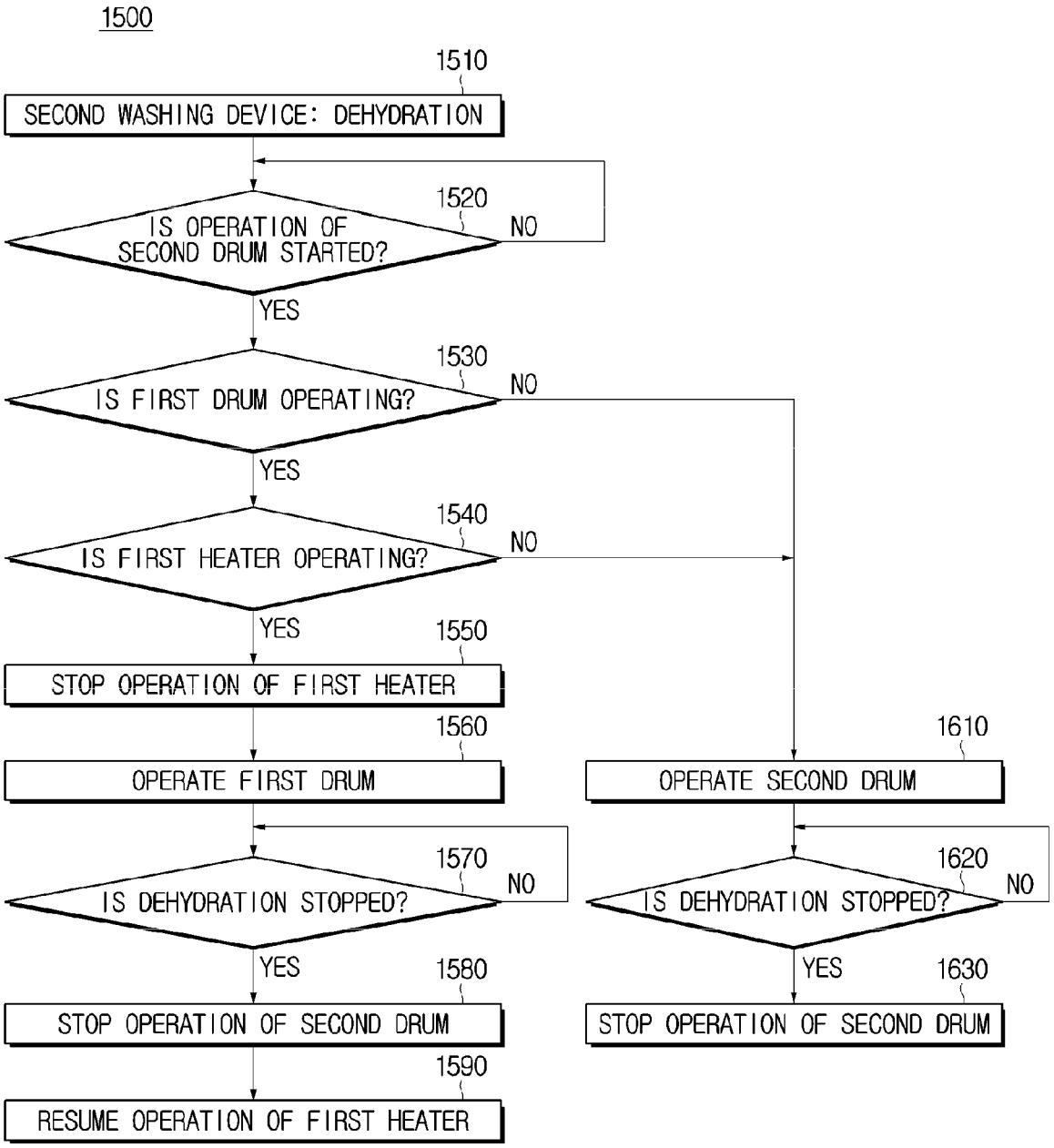
FIG. 19 is a flowchart illustrating operation of a washing machine, according to another embodiment of the present disclosure.
Figure 20:
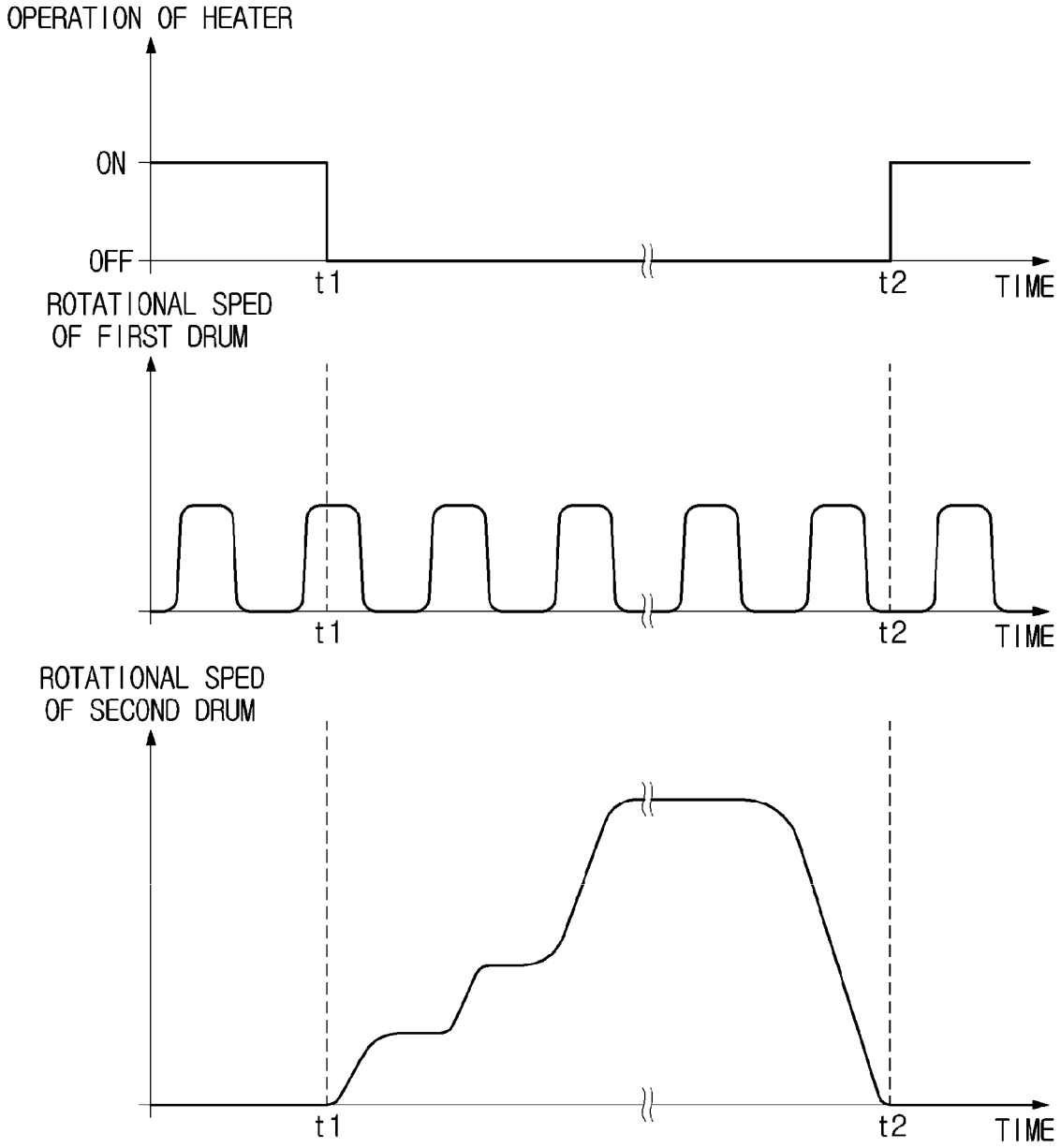
FIG. 20 shows an example of operation of a heater and operation of a drum according to operation of the washing machine shown in FIG. 19.

FIG. 19 shows another example of operation of a washing machine, according to an embodiment of the present disclosure, and FIG. 20 shows an example of operation of a heater and operation of a drum according to operation of the washing machine shown in FIG. 19.

As shown in FIGS. 19 and 20, operation 1500 of the washing machine 1 during washing or rinsing of the first washing device 10 and dehydration of the second washing device 20 will be described.

The washing machine 1 starts dehydration of the second washing device 20, in 1510.

When water drainage from a washing course or a rinsing course of the second washing device 20 is completed, the washing machine 1 may start dehydration of the second washing device 20.

The washing machine 1 determines whether to start operation of the second drum 23, in 1520.

The washing machine 1 may start intermediate dehydration of a washing course, intermediate dehydration of a rinsing course, or final dehydration of a dehydration course. The washing machine may control the second driver 140 to rotate the second drum 23 at high speed during dehydration of the second washing device 20.

Furthermore, the washing machine 1 may determine whether to start operation of the first drum 13 at the start of dehydration.

Specifically, if it is determined that operation of the second drum 23 is started in 1520, the washing machine 1 determines whether the first drum 13 is operating for washing or rinsing in 1530. Determining whether the first drum is operating may include determining whether the first drum 13 is operating based on whether the first speed instruction is output.

If the first drum 13 is operating in 1530, the washing machine 1 determines whether the first heater 18 is operating, in 1540.

Since the second washing device 20 is dehydrating, the washing machine 1 may only determine whether the first heater 18 is operating. If it is determined that the first heater 18 is operating in 1540, the washing machine 1 stops operation of the first heater 18, in 1550.

Dehydration of the second washing device 20 may be continued for about 5 to 10 minutes. If washing or rinsing of the first washing device 10 is stopped during the dehydration of the second washing device 20, the user might misunderstand this as a malfunction of the washing machine 1. Furthermore, if dehydration of the second washing device 20 is delayed during washing or rinsing of the first washing device 20, the user might also misunderstand this as a malfunction of the washing machine 1.

Accordingly, for convenience for the user, the washing machine 1 may stop operation of the first heater 18 during dehydration of the second washing device 20. At this time, the controller 110 of the washing machine 1 may not output the first heating signal to the first heater 18 or may output a first stop heating signal to the first heater 18.

As shown in FIG. 20, the washing machine 1 may determine whether the first drum 13 and the first heater 18 are operating at the first point of time t1 if the second washing device 20 starts dehydration at the first point of time, and may stop operation of the first heater 110 and start operation of the second drum 23 at the first point of time t1 if it is determined that the first drum 13 and the first heater 18 are operating at the first point of time t1.

The washing machine 1 operates the second drum 23 if the operation of the first heater 18 is stopped, in 1560.

Furthermore, while the second drum 23 is rotating under the operation of the second driver 140, the rotational speed of the second drum 23 may be changed as shown in FIG. 20.

The washing machine 1 determines whether the dehydration is stopped, in 1570.

The dehydration may be performed for a predetermined set time or for a time set by the user.

The washing machine 1 may determine whether the time for which the dehydration has been performed is longer than the set time.

If it is determined that the dehydration is completed in 1570, the washing machine 1 stops operation of the second drum 23, in 1580.

If the time for which the dehydration has been performed is longer than the set time, the washing machine 1 may control the second driver 140 to stop rotation of the second drum 23.

When the dehydration is stopped, the washing machine 1 resumes operation of the first heater 18, in 1590. At this time, the controller 110 of the washing machine 1 may output the first heating signal to the first heater 18.

If the first drum 13 is not operating in 1530 or the first heater 18 is not operating in 1540, the washing machine 1 operates the second drum 23 in 1610, determines whether dehydration of the second washing device 20 is stopped in 1620, and stops operation of the second drum 23 in 1630 if it is determined that the dehydration of the second washing device 20 is stopped in 1620.

Operations 1610, 1620, and 1630 may be the same as the operations 1560, 1570, and 1580.

While it was described that operation of the first heater 18 is stopped during dehydration of the second washing device 20, operation of the second heater 28 may be stopped during dehydration of the first washing device 1.

As described above, if one of the first and second washing devices 10 and 20 is dehydrating and the other is washing (or rinsing), the washing machine 1 may prevent the heater 150 and the driving motors 40 and 45 from being operated simultaneously.

Specifically, if the first heater 18 and the first driving motor 40 are operating for washing or rinsing and the second driving motor 45 starts being operated for dehydration, the washing machine 1 may stop operation of the first heater 18 while the second driving motor 45 is operating for dehydration.

Furthermore, if the second heater 28 and the second driving motor 45 are operating for washing or rinsing and the first driving motor 40 starts being operated for dehydration, the washing machine 1 may stop operation of the second heater 28 while the first driving motor 40 is operating for dehydration.

As a result, the washing machine 1 may prevent a dramatic increase in power consumption.

In the embodiment, during rotation of the first drum of the first washing device and the second drum of the second washing device, the speed and accelerated speed may be controlled by obtaining load information at each start point of the operation and changing parameters based on the load information. This will be explained in another example.

Figure 21:
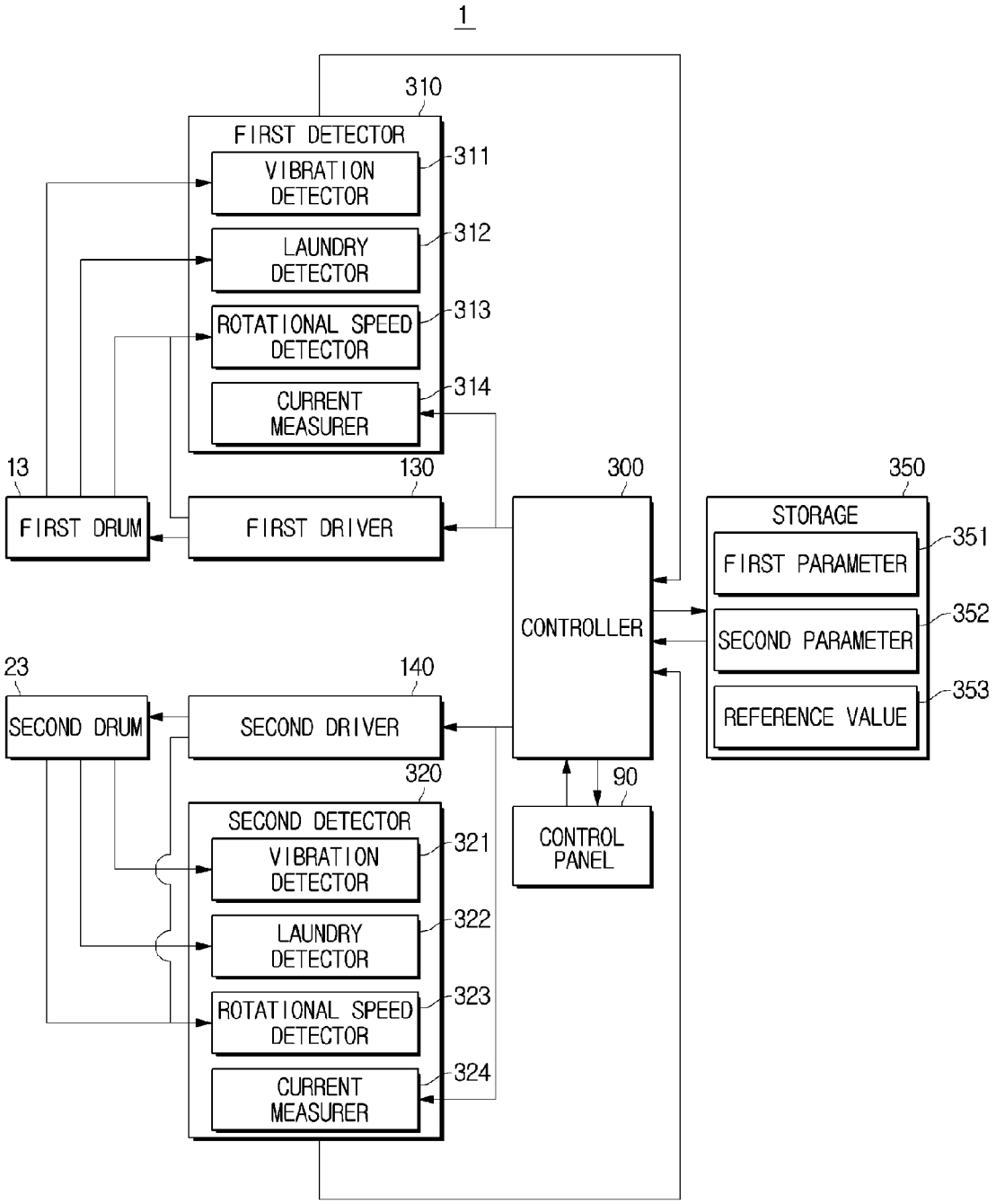
FIG. 21 is a control block diagram of a washing machine, according to another embodiment of the present disclosure.

FIG. 21 is a control block diagram of a washing machine, according to another embodiment of the present disclosure.

As shown in FIG. 21, the washing machine 1 may include the control panel 90, the first drum 13, the driver 130, the second drum 23, and the second driver 140, and may further include a controller 300 and a storage 350, and may include a first detector 310 or a second detector 320, or may include both the first and second detectors 310 and 320.

The control panel 90, the first drum 13, the first driver 130, the second drum 23, and the second driver 140 are described above, so the details thereof will be omitted below.

Control operation of the controller 300 will be described in more detail later.

The first detector 310 is provided to detect operation of at least one of the first drum 13 and the first driver 130 and obtain the associated information.

The first detector 310 may include at least one of a vibration detector 311, a laundry detector 312, a rotational speed detector 313, and a current measurer 314.

The vibration detector 311 detects vibrations of the first drum 13 or the surrounding parts (e.g., the first tub 120) caused by rotation of the first drum 13, and outputs an electric signal corresponding to the detected vibration. The vibration detector 311 may be implemented using e.g., a piezoelectric acceleration type vibration sensor or a cantilever vibration type vibration sensor.

The laundry detector 312 may detect the form or extent of movement of the laundry inside the first drum 13 while the first drum 13 is operating. The laundry detector 312 may be implemented using e.g., a photo sensor, an ultrasonic sensor, a pressure-sensitive sensor, a weight sensor, etc.

The rotational speed detector 313 may detect the rotational speed of the first driving shaft 31 of the first driver 130 or the rotational speed of the first drum 13.

The current measurer 314 may measure the level of a current applied to the first driver 130 and send the measured level of the current to the controller 300. At this time, a control signal from the controller 300 is sent and applied to the first driver 130 in the form of an electric signal.

The current measurer 314 may measure the level of a current of the electric signal applied, and send the measurement result to the controller 300 in the form of an electric signal. In this case, the current measurer 314 may measure the level of a current applied to the first driver 130 by receiving a feedback signal corresponding to the electric signal applied to the first driver 130 and measuring the level of the current, which is the feedback signal.

The first detector 310 may further include a water stream detector (not shown) for detecting or measuring the form of movement of a water stream inside the first drum 13, e.g., a movement direction or velocity of the water stream. The first detector 310 sends various kinds of detected information to the controller 300.

The second detector 320 is provided to detect operation of at least one of the second drum 23 and the second driver 140 to obtain the associated information.

The second detector 320 may include at least one of a vibration detector 321, a laundry detector 322, a rotational speed detector 323, and a current measurer 324.

The second detector 320 may further include a water stream detector (not shown).

The vibration detector 321, the laundry detector 322, the rotational speed detector 323 and the current measurer 324 of the second detector 320 are substantially the same as the vibration detector 311, the laundry detector 312, the rotational speed detector 313 and the current measurer 314 of the first detector 310, respectively, in terms of the structure, operation and embodiment, so the description thereof will be omitted below.

The second detector 320 sends various kinds of detected information to the controller 300.

The storage 350 may store various kinds of information required for operation of the washing machine 1. For example, the storage 350 may store applications related to computation, processing, and control operations of the processor 200 or information required for the computation, processing and control operations, and more particularly, may store at least one of a first parameter 351, a second parameter 352, and a reference value 353.

Referring to FIGS. 22 to 25, a procedure in which the controller 300 controls at least one of the first and second washing devices 10 and 20 of the washing machine 1 will be described in detail.

Figure 22:
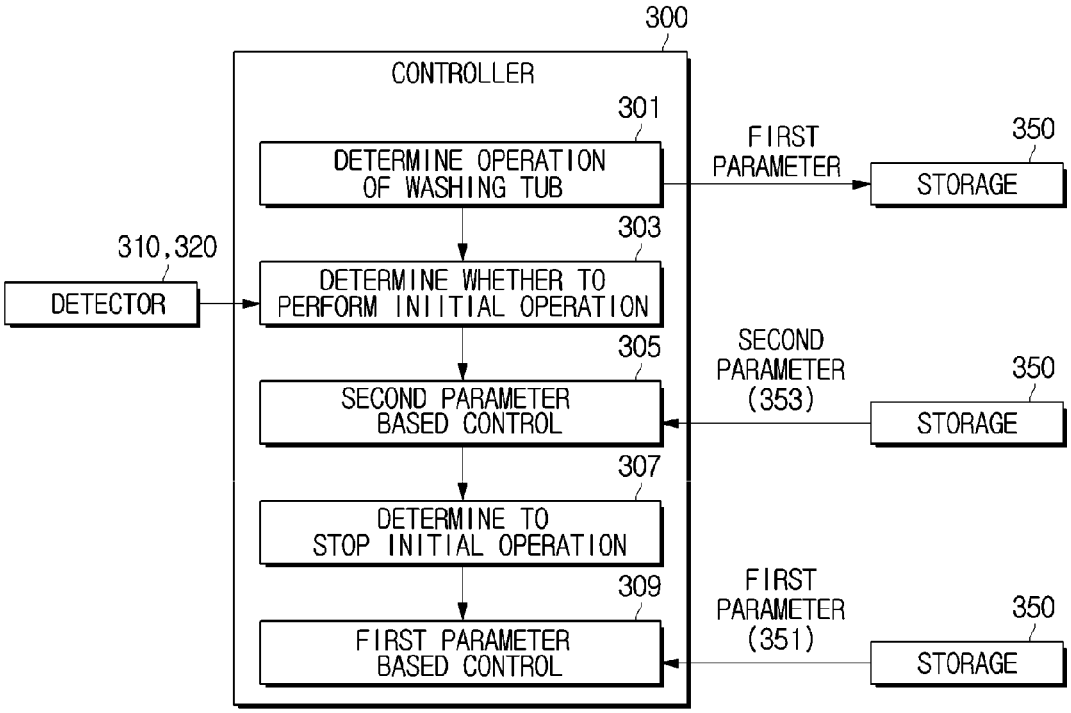
FIG. 22 is a diagram for explaining operation of a controller, according to an embodiment of the present disclosure.
Figure 23:
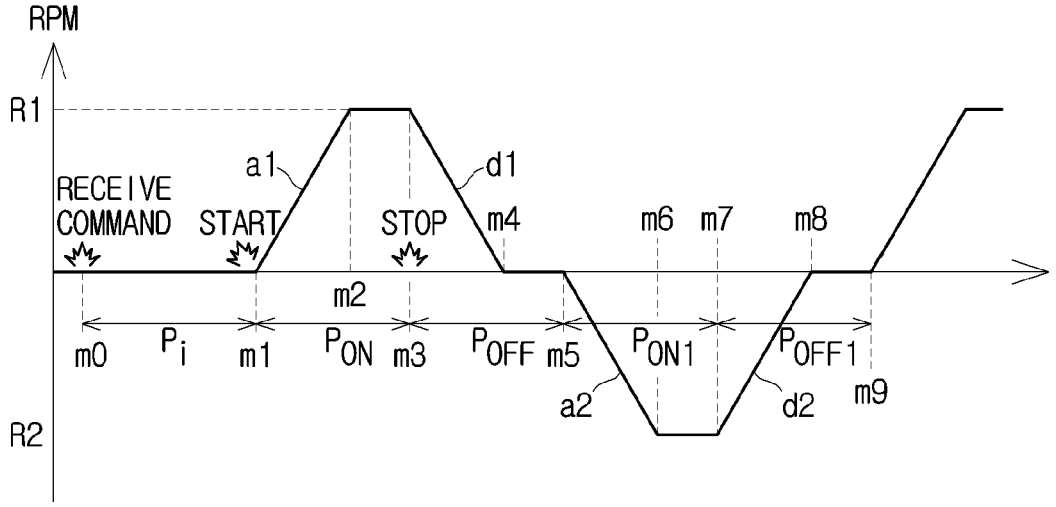
FIG. 23 is a graph for explaining operation of a drum based on a first parameter, according to an embodiment of the present disclosure.

FIG. 22 is a diagram for explaining operation of a controller, and FIG. 23 is a graph for explaining operation of a drum based on a first parameter.

In FIG. 23, the X-axis represents the time and the Y-axis represents RPM of the drum 110, 210. Positive and negative signs on the Y-axis mean different rotational directions, and the rotational direction corresponding to the positive sign and the rotational direction corresponding to the negative sign may be arbitrarily defined by the designer.

Referring to FIG. 22, the controller 300 may determine operation of at least one of the first and second washing devices 10 and 20 based on predefined settings in the storage 350 and/or signals output from the control panel 90 according to the user's manipulation of the control panel 90, in 301.

The controller 300 may generate a certain control signal based on information received from at least one of the first and second detectors 310 and 320, and determine operation of at least one of the first and second washing devices 10 and 20 based on the generated control signal.

Operation of the first washing device 10 may include operation of the first drum 13 and/or operation of the first driver 130 coupled to the first drum 13, and operation of the second washing device 20 may include operation of the second drum 23 and/or operation of the second driver 140 coupled to the second drum 23.

The determining of operation of at least one of the first and second washing devices 10 and 20 may be performed after at least one of a washing course, a rinsing course, and a dehydration course is started and/or in the process of performing at least one of a washing course, a rinsing course, and a dehydration course.

The controller 3000 may determine at least one parameter 351 (hereinafter referred to as a first parameter) relating to operation of at least one of the first and second washing devices 10 and 20, and determine operation of the second washing device 20 based on the first parameter 351.

The first parameter 351 may be temporarily or non-temporarily stored in the storage 350.

The controller 300 may determine the first parameter 351 corresponding to each washing device, i.e., each of the first and second washing devices 10 and 20. In this case, the controller 300 may determine the first parameter 351 only for operation of the second washing device 20, or for each of the plurality of washing devices 10 and 20.

In the latter case where the first parameter 351 is determined for each of the plurality of washing devices 10 and 20, the first parameters 351 corresponding to the plurality of washing devices 10 and 20 may be the same or may be different from each other.

The first parameter 351 may include at least one of operation ratio, rotational acceleration and rotational deceleration.

The rotational acceleration refers to an increasing rate of rotational speed of the drum 13, 23 or the driving shaft 31, 41 in time, and the rotational deceleration refers to a decreasing rate of rotational speed of the drum 13, 23 or the driving shaft 31, 41 in time.

The operation ratio refers to a ratio of a period in which the driver 130, 140 performs relatively active operation during a reference period and/or a period in which the drum 13, 23 of the washing device 10, 20 is rotated with acceleration during the reference period.

Specifically, referring to FIG. 23, in a period Pon between a first point m1 and a third point m3 or a period Pon1 between a fifth point m5 and a seventh point m7, the driver 140, 240 performs relatively active operation by increasing the rotational speed of the driving shaft 31, 41 or the drum 13, 23 (a1, a2) or maintaining the rotational speed of the driving shaft 31, 41 or the drum 13, 23 at a relatively high speed R1 in response to reception of a control signal or application of a current.

The rotational acceleration refers to an increasing rate (i.e., a slope of a plot corresponding to a1 or a2 of FIG. 23) of the rotational speed in this process.

On the contrary, in a period Poff between a third point m3 and a fifth point m5 and a period Poff2 between a seventh point m7 and a ninth point m9, the driver 140, 240 performs inactive operation or performs no operation by decreasing the rotational speed of the driving shaft 31, 41 or the drum 13, 23 (d1, d2) or maintaining the rotational speed of the driving shaft 31, 41 or the drum 13, 23 at 0 or nearly 0.

The rotational deceleration refers to a decreasing rate (i.e., a slope of a plot corresponding to d1 or d2 of FIG. 23) of the rotational speed in this process.

The operation ratio refers to a period Pon, Pon1 in which the driver 130, 140 increases the rotational speed of the driving shaft 31, 41 or the drum 13, 23 or maintains it at the relatively high speed R1 to the reference period Pon+Poff, Pon1+Poff1, Pon+Poff+Pon1+Poff1.

The reference period may include a period in which rotation of the drum 13, 23 or the driving shaft 31, 41 in a particular direction is started and stopped (a period from m1 to t5), or may include a period in which rotation of the drum 13, 23 or the driving shaft 31, 41 in both directions is started and stopped (a period from m1 to t8).

In this way, once the operation of at least one of the first and second washing devices 10 and 20 is determined in 301, the controller 300 may determine whether the determined operation is to perform an operation defined in advance, e.g., an initial operation, in 303.

The initial operation includes a single operation or a series of operations to be performed first in a case that the washing device 10, 20 performs a certain course.

If a command to start operation of the washing machine 1 is input when the existing washing, rinsing, and dehydration courses are completed or when the washing device 10, 20 has not been operated for a predetermined period of time, or operation of the washing device 10, 20 is done or in a stand-by state, the controller 300 may determine that the initial operation is required, and if not, may determine that the initial operation is not required.

If it is determined that the initial operation is not required, the controller 300 may control the washing device 10, 20 based on the first parameter 351.

Specifically, if the washing device 10, 20 is performing an operation, the controller 300 may determine that the initial operation is not required and control the washing device 10, 20 based on the first parameter 351. In this case, the controller 300 may control the first washing device 10 only, or control the second washing device 20 only, or control both the first and second washing device 10 and 20.

A procedure of controlling the washing device 10, 20 based on the first parameter 351 will now be described in detail. For convenience of explanation, operation of the second washing device 20 will be focused as an example. However, the following concepts or operations are not exclusively applied to the second washing device 20, but may be equally applied or applied with partial modification to the first washing device 10.

Referring to FIG. 23, the second driver 140 coupled to the second drum 23 of the second washing device 20 may receive an instruction to start operation from the controller 300 at an initial point of time m0. Instead of receiving the instruction to start operation, a current required to drive the second driver 140 may be applied. The second driver 140 starts operation at the first point of time m1. In other words, the second driving shaft 41 starts rotating in a first direction at the first point of time m1.

The second driver 140 may start operation immediately after receiving the control signal (so, t0 and t1 may be very close or the same) or start operation from the first point m1 after a certain period Pi has elapsed after reception of the control signal (i1).

Once the second driver 140 starts operation, the rotational speed of the second driving shaft 41 increases according to the determined rotational acceleration from the first point m1 to the second point m2, and in response, the rotational speed of the second drum 23 also increases according to the determined rotational acceleration (a1).

The second driver 140 may remain at almost constant speed from the second point m2 to the third point m3 (i.e., the acceleration or deceleration is 0 or nearly 0). The period from the second point m2 to the third point m3 may be determined based on the operation ratio determined by the controller 300.

If the second driver 140 receives an instruction to stop operation from the controller 300 or application of a current to the second driver 140 is stopped at the third point m3, the rotational speed of the second drum 23 decreases according to the determined rotational deceleration (d1).

For a certain period of time after the deceleration is done, the second drum 23 may not be rotated (i.e., the rotational acceleration or rotational deceleration of the second drum 23 or the second driving shaft 41 has the value of 0 or nearly 0).

At the fifth point of time m5, the second drum 23 starts being rotated in the opposite direction (hereinafter, called a second direction) to the first direction according to the operation of the second driver 140 under the control of the controller 300.

As described above, the rotational speed of the second drum 23 is accelerated till the sixth point of time m6 (a2), maintained at a constant speed from the sixth point m6 to a seventh point m7, and decelerated from the seventh point m7 to an eighth point m8 (d2). In the process of deceleration (d2), the second driver 140 may perform deceleration operation or stop operation.

If the second driver 140 stops operation, the rotational speed of the second drum 23 is gradually decelerated by friction with an external part or water. If necessary, a certain braking device may be further used in the deceleration process (d2). The braking device may control the second driving shaft 41 or the second drum 23 to maintain or change the rotational deceleration. The braking device may control the rotational deceleration using an object such as a drum that applies friction or using fluid pressure of air or liquid.

After that, the second drum 23 remains in the stopped state from the eighth point m8 to a ninth point m9 and starts to be rotated in the opposite direction to the second direction, i.e., in the first direction from the ninth point m9. The first direction may be a clockwise direction while the second direction may be a counterclockwise direction.

The above procedure may be continuously repeated until at least one of the washing, rinsing, and dehydration courses is completed.

As such, the second driver 140 alternately rotates the second driving shaft 41, and accordingly, the second drum 23 is alternately rotated to wash, rinse, or dehydrate the laundry in the second drum 23.

Figure 24:
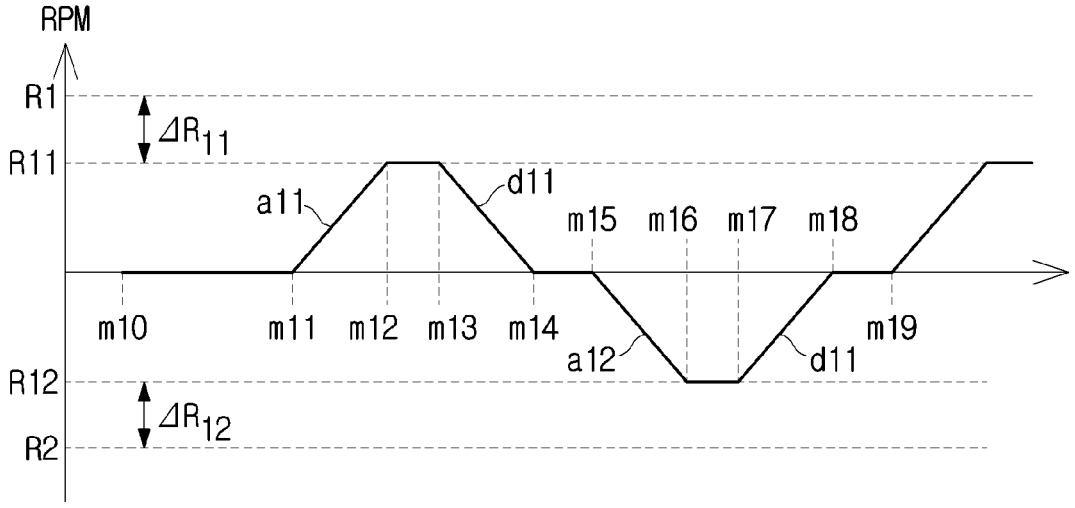
FIG. 24 is a graph for explaining operation of a drum based on a second parameter in a case that an initial operation is performed.

FIG. 24 is a graph for explaining operation of a drum based on a second parameter in a case that an initial operation is performed.

If it is determined that an initial operation needs to be performed, the controller 300 determines a parameter 352 (hereinafter, called a second parameter) related to an initial operation of at least one of the first and second washing devices 10 and 20 to correspond to the initial operation, and determines at least one of the first and second washing devices 10 and 20 based on the second parameter 352. In this case, the controller 300 may determine the second parameter 352 by obtaining it from the storage 350.

Like the first parameter 351, the second parameter 352 may be determined to correspond to each of the first and second washing devices 10 and 20, and if necessary, the controller 300 may determine the second parameter for only one of the washing devices 10 and 20 or for each of the plurality of washing devices 10 and 20.

The second parameter 352 may include at least one of an operation ratio (hereinafter, called a second operation ratio), a rotational acceleration (hereinafter, called a second rotational acceleration), and a rotational deceleration (hereinafter, called a second deceleration).

The second rotational acceleration may be determined to have an absolute value relatively lower than the rotational acceleration of the first parameter 351 (hereinafter, called a first rotational acceleration).

Specifically, as shown in FIGS. 23 and 24, the second rotational acceleration (a11, a12) is relatively lower than the first rotational acceleration a1, a2, and accordingly, for the second parameter 352 based operation, an increase in rotational speed of the drum 110, 210 is relatively slower than in the first parameter 351 based operation.

In this case, if an acceleration section (m1 to m2, t5 to t6) based on the first parameter 351 and an acceleration section (m11 to m12, m15 to m16) based on the second parameter 352 are the same or similar, the maximum rotational speed R11, R12 of the drum 110, 210 that operates based on the second parameter 352 may be relatively lower (ΔR11, ΔR12) than the maximum rotational speed R1, R2 of the drum 110, 210 that operates based on the first parameter 351.

The second rotational deceleration may be determined to have an absolute value relatively lower than the rotational deceleration of the first parameter 351 (hereinafter, called a first rotational deceleration).

Referring to FIGS. 23 and 24, the second rotational deceleration (d11, d12) may be defined to have a relatively more gentle slope than the first rotational deceleration (d1, d2). Accordingly, for the second parameter 352 based operation, a decrease in rotational speed of the drum 110, 210 is slower than in the first parameter 351 based operation.

The second operation ratio may be arbitrarily defined by the designer. In other words, the second operation ratio may be determined regardless of the operation ratio (hereinafter, called a first operation ratio) based on the first parameter 351.

The second operation ratio may be determined to be the same as or lower than or higher than the first operation ratio.

In the case of performing the initial operation, the controller 300 controls the washing device 10, 20 based on the second parameter, as shown in FIG. 24.

For example, the controller 300 sends an instruction to start operation to the second drum 23 of the second washing device 20 at an initial point of time m10, and in response, the second drum 23 starts to be operated in the first direction immediately (m10 and m11 are the same or nearly same) or after the lapse of a certain time.

The rotational speed of the second drum 23 increases (a11) with the second rotational acceleration after the rotation is started. Since the second rotational acceleration is relatively slower than the first rotational acceleration as described above, the rotational speed of the second drum 23 increases relatively slowly in the case of performing the initial operation. Furthermore, the maximum rotational speed R11 of the second drum 23 may also be relatively lower than when controlled based on the first parameter.

The second drum 23 is rotated at the maximum rotational speed R11 for a certain period (m12 to t13) and starts to be rotated with the second rotational deceleration from a thirteenth point m13.

Since the second rotational deceleration has a relatively greater value than the first rotational deceleration as described above, the rotational speed of the second drum 23 decreases relatively slowly in the case of performing the initial operation.

After the rotation of the second drum 23 is done, i.e., after the rotational speed becomes 0 or nearly 0 from m14 to m15, the second drum 23 starts being rotated in the second direction from the fifth point m15. In this case, the rotational speed of the second drum 23 may be accelerated relatively more smoothly till the sixteenth point of time m16 (a12), maintained at a constant speed from the sixteenth point m16 to a seventeenth point m17, and decelerated relatively more smoothly from the seventeenth point m17 to an eighteenth point m8 (d12).

After the initial operation is done, the controller 300 may determine whether to further perform the initial operation. That is, the controller 300 may determine whether to stop the initial operation. In this case, the controller 300 may determine whether the initial operation needs to further be performed based on a predefined condition.

For example, the predefined condition may include an occasion when the rotational speed of the drum 13, 23 does not reach a predetermined target rotational speed, an occasion when an overcurrent is applied to the driver 130, 140 coupled to the drum 13, 23, an occasion when the laundry distribution is unbalanced inside the drum 13, 23, an occasion when the vibration of the drum 13, 23 is determined to be lower than a certain reference, and/or an occasion when the fluid velocity of a water stream inside the drum 13, 23 is faster than a certain reference. Besides, other various conditions that may be considered by the designer may be set to determine whether the initial operation needs to further be performed.

The rotational speed of the drum 13, 23 may be measured by the rotational speed detector 313, 323, and the current applied to the driver 130, 140 may be measured by the current measurer 314, 324.

The unbalanced distribution of the laundry may be detected by the laundry detector 312. The unbalanced distribution of the laundry means a situation where clothes are gathered at a particular location inside the drum 110, 210 without being widely spread in the drum 110, 210. Furthermore, the vibration may be detected by the vibration detector 311, and the fluid velocity of a water stream may be measured by a water stream measurer.

If it is determined that the initial operation needs to further be performed, the controller 300 may control the drum 110, 210 to be operated with the initial operation, as described above in connection with FIG. 24.

For example, if the controller 300 controls the drum 12, 22 based on the initial operation but determines that the rotational speed of the drum 12, 22 detected by the rotational speed detector 313, 323 is lower than the predefined target rotational speed, the controller 300 determines that the initial operation needs to further be performed and may thus control the drum 12, 22 to keep on operating under the initial operation as described above in connection with FIG. 24.

If it is determined that the initial operation does not need to further be performed, initial operation is determined to be stopped, in 307. Subsequently, the controller 300 may control the drum 10, 20 based on the first parameter 351, in 309, as described above with reference to FIG. 23. In this case, the controller 300 may call out the first parameter 351 stored in the storage 350 after determining operation of a drum in 301, and control the drum 12, 23 based on the first parameter 351.

Referring to FIGS. 25 to 28, a procedure in which the controller 300 controls the first and second washing devices 10 and 20 of the washing machine 1 will now be described in detail.

Figure 25:
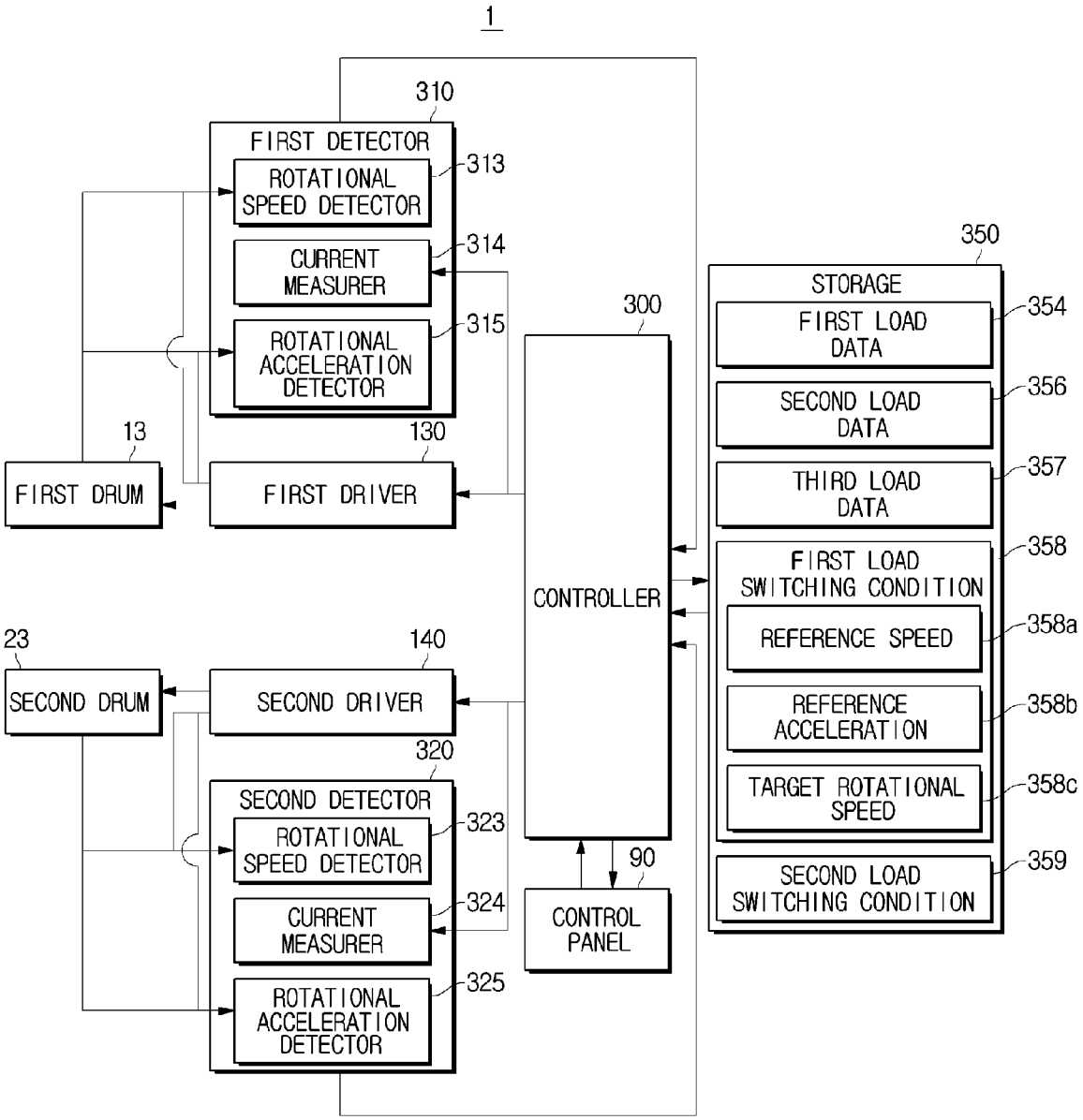
FIG. 25 is a control block diagram of a washing machine, according to another embodiment of the present disclosure.

FIG. 25 is a control block diagram of a washing machine, according to another embodiment of the present disclosure.

Referring to FIG. 25, the washing machine 1 may include the control panel 90, the first drum 13, the first driver 130, the second drum 23, the second driver 140, the controller 300, and the storage 350.

The control panel 90, the first drum 13, the first driver 130, the second drum 23, and the second driver 140 are described above, so the details thereof will be omitted below.

The controller 300 may generate a control signal for at least one of the first and second drivers 130 and 140 based on at least one of first load data 354, second load data 356, third load data 357, and a first load switching condition 358. This will be described later.

The storage 350 may store various information required for operation of the washing machine 1, for example, at least one of the first load data 354, the second load data 356, the third load data 357, and the first load switching condition 358.

The load data 354, 356, and 357 refers to data for a load applied to at least one of the first drum 13 and the second drum 23 or at least one of the first driver 130 and the second driver 140 due to the laundry thrown into the at least one of the first drum 13 and the second drum 23.

The load increases substantially in proportion to the amount, weight, or water content of the laundry. The load data 354, 356, and 357 may include at least one of data for a load measured in a washing course, a rinsing course, and/or a dehydration course, data for a load measured in advance, and data for a load estimated by the designer.

The load data 354, 356, and 357 may include the first load data 354 representing a first load, the second load data 356 representing a second load, and the third load data 357 representing a third load. The first, second, and third loads may be different from each other: for example, the second load may be defined as being smaller than the first load and the third load may be defined as being higher than the first load.

In this regard, it is possible to omit the third load data 357. The first load data 354, the second load data 356, and the third load data 357 may be defined arbitrarily by the designer's choice. Details of the first load data 354, the second load data 356, and the third load data 357 will be described later.

In addition, details of the structure, operation, or embodiment of the controller 300 and the storage 350 are the same as what are described above, so the detailed description thereof will be omitted.

The washing machine 1 may include at least one of the first detector 310 and the second detector 320, as shown in FIG. 25.

The first detector 310 may include at least one of the rotational speed detector 313, the current measurer 314, and the rotational acceleration detector 315. In addition, the first detector 310 may further include the vibration detector 311 or the laundry detector 312 as described above.

The rotational acceleration detector 315 measures rotational acceleration or rotational deceleration of the first drum 13, and outputs and sends an electric signal corresponding to the measurement result to the controller 300. The rotational acceleration detector 315 may be implemented using a coin type, piezoelectric type, thermo type, or strain gauge type acceleration sensor, and even using an inertia-based acceleration sensor or gyro sensor if required.

The second detector 320 may include at least one of the rotational speed detector 323, the current measurer 324, and the rotational acceleration detector 325. Like what is described above, the second detector 320 may further include at least one of the vibration detector 321 and the laundry detector 322.

The rotational speed detector 313 and the current measurer 314 of the first detector 310 and the rotational speed detector 323 and the current measurer 324 of the second detector 320 are described above in connection with FIG. 23, so the detailed description thereof will be omitted.

Figure 26:
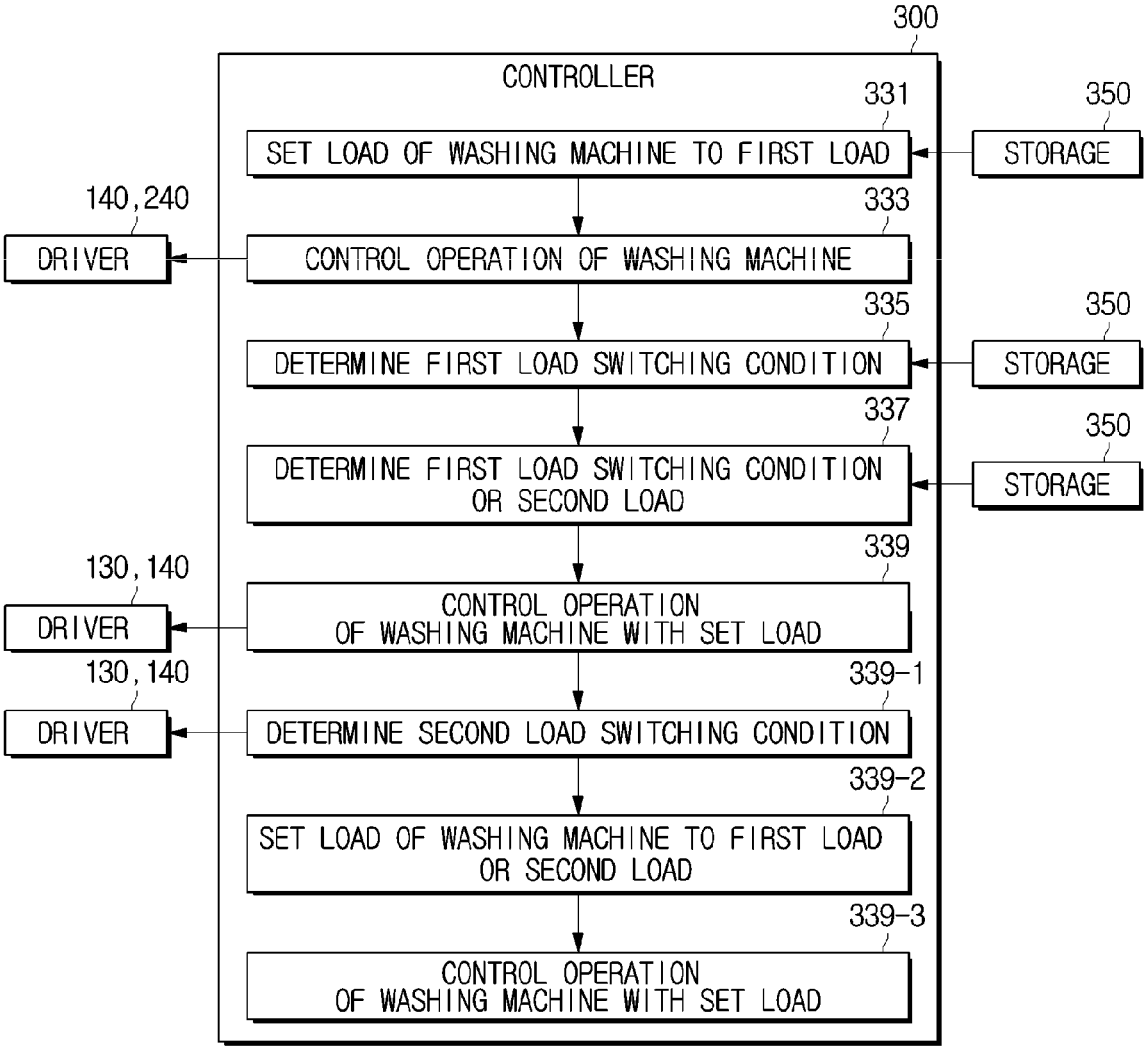
FIG. 26 is a diagram for explaining operation of a controller, according to another embodiment of the present disclosure.
Figure 27:
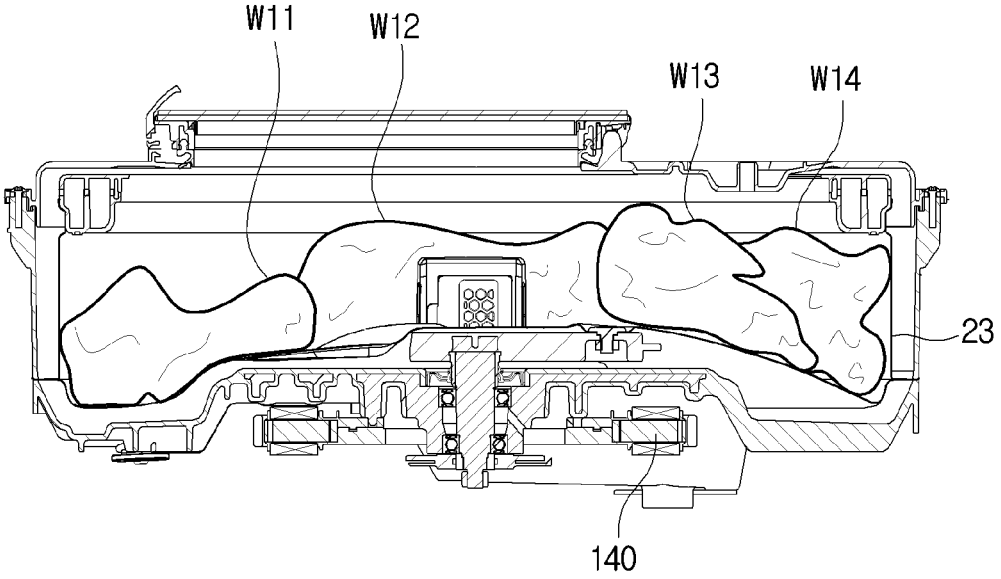
FIG. 27 is a view for explaining an amount of laundry corresponding to a first load.
Figure 28:
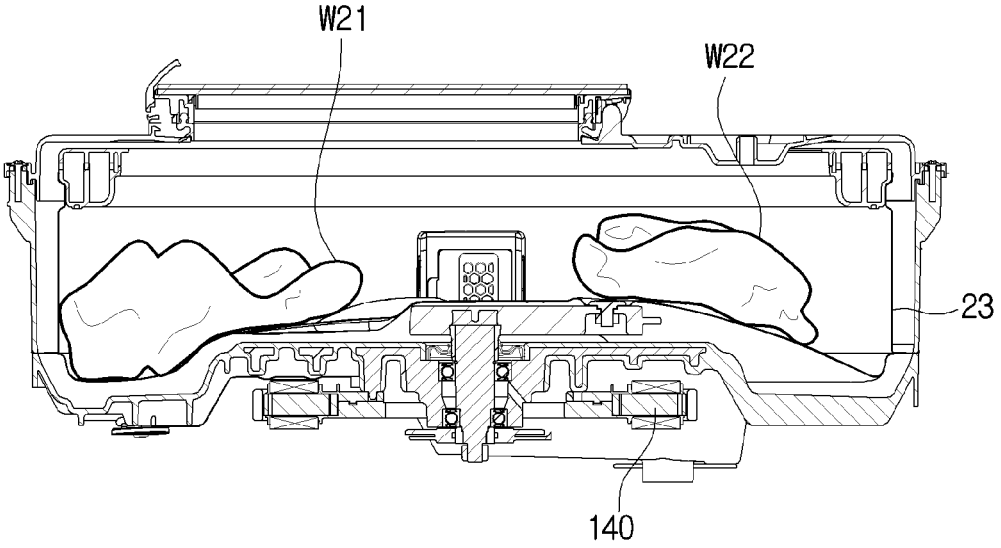
FIG. 28 is a view for explaining an amount of laundry corresponding to a second load.

Referring to FIGS. 26 to 28, a procedure in which the controller 300 controls at least one of the first and second washing devices 10 and 20 of the washing machine 1 will be described in detail.

FIG. 26 is a diagram for explaining operation of a controller according to another embodiment, and FIG. 27 is a view for explaining an amount of laundry corresponding to a first load. FIG. 28 is a view for explaining an amount of laundry corresponding to a second load. In the following description, for convenience of explanation, an example where the controller 300 controls operation of the second drum 23 will be focused.

However, the following concepts, procedures, structures, or operations are not limited to controlling the second washing device 20, but may be equally applied or applied with partial modification to a process of controlling the first washing device 10.

Referring to FIG. 26, the controller 300 may first read out the first load data 354 from the storage 350 and set the first load obtained from the first load data 354 to a load of the second drum 23. In other words, the load of the second drum 23 is set to be the first load. Setting the load of the second drum 23 to the first load may be performed in response to the start of operation of the washing machine 1.

The first load may include a load corresponding to an amount of laundry typically expected to be thrown in by the user. For example, the first load may refer to a load applied to the second drum 23 or the second driver 140 when the laundry W11 to W14 is properly thrown into the second drum 23, as shown in FIG. 27. In other words, the first load may refer to a load corresponding to the laundry W11 to W14 smaller than the maximum amount of what is thrown into the second drum 23 and larger than a minimum amount of what is thrown into the second drum 23.

When the load of the second drum 23 is set to the first load, the controller 300 may control the second driver 140 according to the first load, in 333. Accordingly, the second drum 23 is rotated with acceleration in at least one direction to perform the washing, rinsing, or dehydrating course. In this case, when the first load is applied, the controller 300 controls the second driver 140 to perform an operation corresponding to the first load by applying a current or sending a corresponding control signal for the second driver 140 to properly perform the washing, rinsing, or dehydrating course.

The controller 300 may determine whether a change in load is required based on the first load switching condition 358 stored in the storage 350. In other words, the controller 300 may determine whether to continue to control the operation of the second drum 23 based on the first load or control the operation of the second drum 23 based on a load other than the first load, e.g., the second load, in 335.

In this case, the controller 300 may determine whether a change in load is required after the washing machine performs a predetermined operation based on the first load. For example, the controller 300 may determine whether a change in load is required based on the first load switching condition 358 after the accelerated rotation a1, a2, a12, a22 of the second drum 23 is done.

The first load switching condition 358 may include at least one of whether the rotational speed of the second drum 23 exceeds reference speed 358*a*, whether the rotational acceleration of the second drum 23 exceeds reference acceleration 358*b*, and an error between a target rotational speed 358*c* and actual rotational speed of the second drum 23.

For example, the controller 300 may determine to change the first load to the second load if the rotational speed measured with the rotational speed detector 323 exceeds the reference speed 385*a* set by the designer or the user, if the rotational acceleration calculated based on a series of rotational speeds measured with the rotational acceleration detector 325 or detected by the rotational speed detector 323 exceeds the reference acceleration 358*b* defined by the designer or the user, and/or if a difference between the rotational speed measured with the rotational speed detector 323 and the target rotational speed 358*c* defined by the designer or the user does not exceed a predetermined reference value, and otherwise, may determine to maintain the first load.

If it is determined to maintain the first load, the controller 300 sets the load of the second drum 23 to the first load, in 337 and continues to control the second driver 140 based on the first load in the same way as it has done before, in 339.

Otherwise if it is determined to change the first load to the second load, the controller 300 sets the load of the second drum 23 to the second load, in 337 and controls the second driver 140 based on the second load, in 339. Accordingly, the second drum 23 is rotated with acceleration in at least one direction based on at least one of rotational speed, rotational acceleration, and rotational deceleration different from what is described above.

The second load may be defined as a load of when a relatively small amount of laundry is thrown in than in an occasion when a normal amount of laundry is thrown in. For example, the second load may refer to a load applied to the second drum 23 or the second driver 140 when a relatively small amount of laundry W21 to W24, e.g., one or two shirts, are thrown into the second drum 23, as shown in FIG. 28.

If the second driver 140 is controlled based on the load of the second drum 23 estimated and defined to be the first load, which is relatively high, even if the load of the second drum 23 is actually a relatively low load, for example, the second load or a similar load, the laundry thrown into the second drum 23 may be fixed to the edge of the second drum 23, which may cause unbalanced distribution of the laundry. In this case, a particular course is unexpectedly re-tried or strong vibration might occur to the washing machine 1. Such adverse reaction may be prevented by setting the load of the second drum 23 to the second load, which is relatively low, and controlling the second driver 140 based on the second load, as described above.

The controller 300 may also set the load of the second drum 23 to a third load if the rotational speed of the second drum 23 exceeds another predetermined reference speed, if the rotational acceleration of the second drum 23 exceeds another predetermined reference acceleration, and/or if a difference between the target rotational speed and the actual rotational speed of the second drum 23 exceeds another predetermined reference value. The third load may refer to a load of when the laundry as much as a maximum limit or the similar amount is thrown into the second drum 23.

If the second drum 23 is controlled based on the changed second load or if the second drum 23 is controlled based on the second load for another reason, the controller 300 may determine whether the second load is to be changed based on a second load switching condition 359, in 339-1.

The second load switching condition 359 may include whether an estimated flux value exceeds a predetermined reference value. Furthermore, the second load switching condition 359 may be implemented based on whether an error between an operation of the second drum 23 under an instruction from the controller 300 and an actually measured operation of the second drum 23 exceeds a reference value. In this case, the controller 300 may determine whether the error between the operation of the second drum 23 under an instruction from the controller 300 and the actually measured operation of the second drum 23 exceeds a reference value by comparison between the level of a current or the magnitude of a frequency of an alternate current (AC) applied to the motor and the actual operation.

If the error between the operation of the second drum 23 under the instruction and the actually measured operation of the second drum 23 exceeds the reference value, the controller 300 may determine that the second load switching condition 359 is met, and change and set the load of the second drum 23 from the second load to the first load, in 339-2. Subsequently, the controller 300 may continue to control the second driver 140 according to the first load, in 339-3.

On the contrary, if the error between the operation of the second drum 23 under the instruction and the actually measured operation of the second drum 23 does not exceed the reference value, the controller 300 may determine that the second load switching condition 359 is not met, maintain the load of the second drum 23 to be the second load in 339-2, and continue to control the second driver 140 according to the second load in 339-3.

Various embodiments of a control method of a washing machine will now be described with reference to FIGS. 29 and 30.

Figure 29:
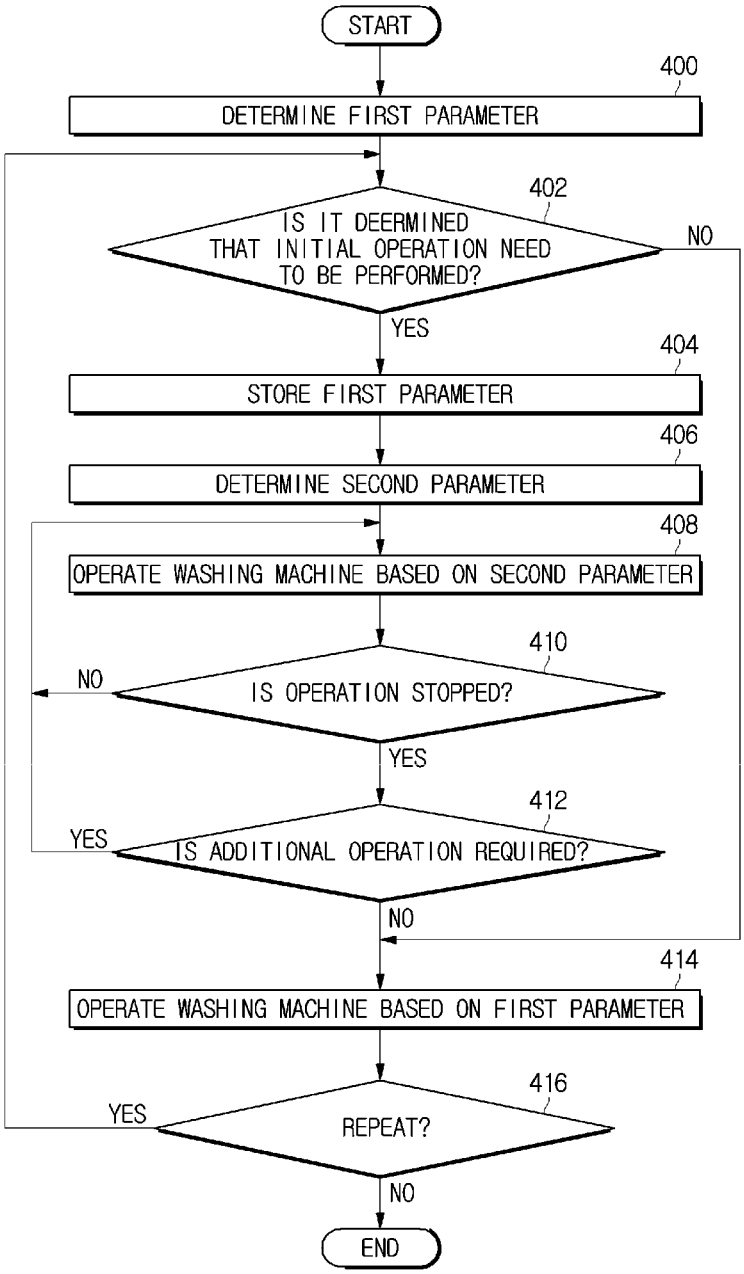
FIG. 29 is a flowchart of a control method of a washing machine, according to an embodiment of the present disclosure.

FIG. 29 is a flowchart of a control method of a washing machine, according to an embodiment of the present disclosure.

Referring to FIG. 29, a washing machine determines a first parameter, in 400.

The determining of the first parameter may be performed right after the washing machine is started or after the lapse of a certain period of time after the washing machine is started. The washing machine may include at least one drum, e.g., two drums.

The first parameter may include various setting values related to operation of at least one drum.

If there are a plurality of drums, the first parameter may be set for each of the plurality of drums or for some of the plurality of drums.

The first parameter 351 may include at least one of the first operation ratio, the first rotational acceleration, and the first rotational deceleration of at least one drum.

Once the first parameter is determined, the washing machine may determine whether an initial operation needs to be performed, in 402. The initial operation includes a single operation or a series of operations to be performed first and foremost in performing a particular course.

If it is determined that the initial operation does not need to be performed because the drum is already performing a certain operation or is on temporarily standby after performing a particular operation in 402, the washing machine may control a drum corresponding to the first parameter, which is determined using the first parameter, in 414. Accordingly, at least one drum operates based on the first parameter.

If the initial operation needs to be performed in 402, the first parameter may be stored in a storage equipped in the washing machine and/or in a separate external device, in 404. At the same time, or subsequently, the washing machine determines the second parameter, in 406.

The second parameter may be determined to correspond to the first parameter.

Like the first parameter, the second parameter may include various setting values related to operation of at least one drum. If there are a plurality of drums, the second parameter may be determined for each of the plurality of drums. In this case, the second parameters determined for the plurality of drums may be the same or different from each other. Alternatively, the second parameter may be determined for some of the plurality of drums. For example, the second parameter may include at least one of the second operation ratio, the second rotational acceleration, and the second rotational deceleration of at least one drum.

The second rotational acceleration may be determined to have an absolute value relatively lower than the first rotational acceleration, and the second rotational deceleration may be determined to have an absolute value relatively less than the first rotational deceleration. The second operation ratio may be defined arbitrarily by the designer's choice.

Once the second parameter is determined, the washing machine may perform a certain operation based on the second parameter, in 408. For example, at least one drum of the washing machine performs accelerated rotation or decelerated rotation based on the determined second rotational acceleration and the second rotational deceleration.

When the operation of the washing machine based on the second parameter is completed, in 410, the washing machine determines whether an additional operation is required, in 412. In other words, it is determined whether the washing machine is to perform an initial operation. Whether the initial operation needs to be performed may be determined using at least one of e.g., a movement form of a water stream in the drum, a movement form of the laundry in the drum, an unbalanced level of the laundry, rotational speed of the drum, vibration of the drum, and a current applied to the driver for driving the drum.

If it is determined that the initial operation needs to be performed in 412, the washing machine may further perform a certain operation based on the second parameter a certain number of times or for a certain period of time, in 408, 410.

If it is determined that the initial operation does not need to be performed in 412, the washing machine obtains the predetermined first parameter from e.g., a storage and performs a certain operation based on the first parameter in 414.

The operations 402 to 414 may not be repeated or may be repeated at least two or more times according to the designer's or user's choice, in 416.

Figure 30:
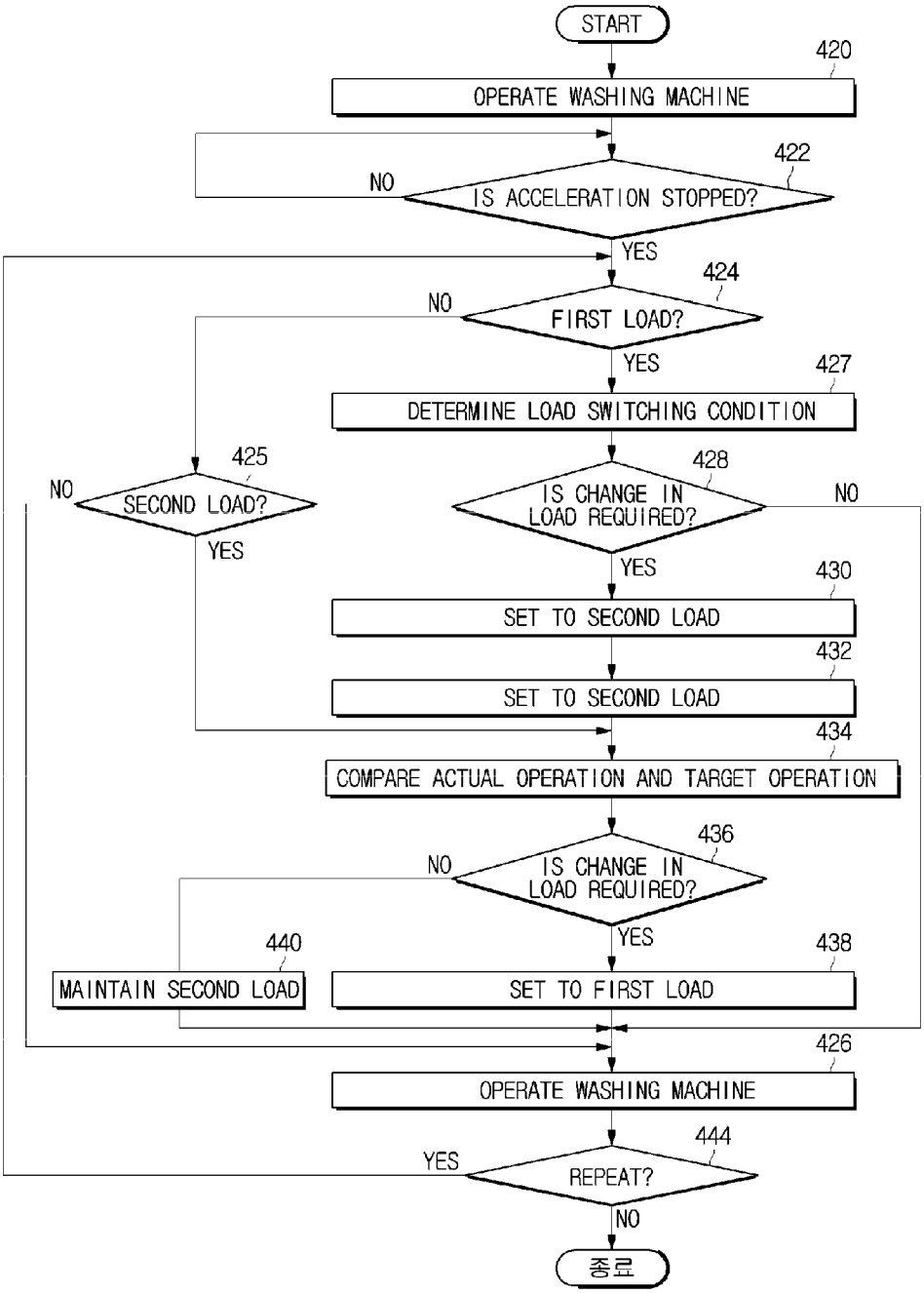
FIG. 30 is a flowchart of a control method of a washing machine, according to another embodiment of the present disclosure.

FIG. 30 is a flowchart of a control method of a washing machine, according to another embodiment of the present disclosure.

Referring to FIG. 30, a washing machine determines a certain operation first, in 420.

The certain operation may include at least one of a plurality of operations that may be performed by the washing machine. The at least one operation may include e.g., an accelerated rotation operation, i.e., an operation in which the rotational speed of the drum increases.

The at least one drum may be operated according to a load set before the operation of the drum. The load may be selected by the controller or the user from among a plurality of loads.

The plurality of loads may include, e.g., a first load, a second load, and a third load. In other words, the at least one drum may be operated based on a load, e.g., the first load, selected from among the plurality of loads.

The first, second, and third loads may be differently defined. For example, the second load may be defined as being smaller than the first load and the third load may be defined as being higher than the first load.

If a preset operation of a drum, e.g., an accelerated rotation operation of at least one drum is done in 422 and a load set to correspond to the at least one drum is a separately predefined load, e.g., the first load in 424, the washing machine determines whether a change in load is required in 427, 428.

In this case, whether a change in load is required may be determined based on a separately set first load switching condition.

The first load switching condition may include at least one of whether the rotational speed of the drum exceeds reference speed, whether the rotational acceleration of the drum exceeds reference acceleration, and an error between a target rotational speed and actual rotational speed of the drum.

Specifically, if the rotational speed of the drum exceeds the reference speed defined by the designer or the user, the rotational acceleration of the drum exceeds the reference acceleration defined by the designer or the user, and an error between a target rotational speed and actual rotational speed of the drum is smaller than a predetermined reference value, it may be determined that a change in load is required.

On the contrary, if the rotational speed of the drum is less than the reference speed defined by the designer or the user, the rotational acceleration of the drum is less than the reference acceleration defined by the designer or the user, or the error between a target rotational speed and actual rotational speed of the drum is greater than the predetermined reference value, it may be determined that a change in load is not required.

If it is determined that a change in load is required in 428, the washing machine sets a load corresponding to at least one drum to the second load in 430, and operates the at least one drum based on the second load in 432.

Otherwise if it is determined that a change in load is not required, the washing machine operates the at least one drum based on the set first load, in 426.

If a preset operation of a drum, e.g., an accelerated rotation operation of at least one drum is done in 422 and a load set to correspond to the at least one drum is another separately predefined load, e.g., the second load in 425, the washing machine determines the second load switching condition in 434.

As shown in FIG. 30, determining the second load switching condition may be performed even after the at least one drum is operated based on the second load according to the result of determination of the first load switching condition.

The second load switching condition may include whether an estimated flux value exceeds a predetermined reference value, which may be determined based on whether an error between an actual operation and the target operation of the at least one drum exceeds a predetermined reference value, in 434, 436.

In the present embodiment, if the error between the actual operation and the target operation of the at least one drum is larger than the predetermined reference value, it may be determined that a change in load is required, and otherwise if the error between the actual operation and the target operation of the at least one drum is less than the predetermined reference value, it may be determined that a change in load is not required.

If it is determined that a change in load is required from the determination of the second load switching condition, in 436, the washing machine sets the load of the at least one drum to the first load from the second load, in 438. The washing machine operates the at least one drum based on the first load, in 426.

On the contrary, if it is determined that a change in load is not required from the determination of the second load switching condition, in 440, the load change is not performed and the washing machine maintains the load of the at least one drum to be the second load, in 440. In this case, the washing machine operates the at least one drum with the second load, in 426.

If the set operation of the drum, e.g., an accelerated rotation operation of a least one drum is done in 422 and a load set to correspond to the at least one drum is neither the first load nor the second load in 425, the washing machine may set the drum to a default value and operates the drum based on the default value, in 426.

The operations 424 to 426 may be repeated at least one time according to the designer's or the user's choice in an embodiment.

According to an embodiment of the present disclosure, a washing machine equipped with a front-loading type washing device and a top-loading type washing device may be provided.

According to an embodiment of the present disclosure, a washing machine having multiple washing devices and limiting the power consumption to no more than an upper limit may be provided.

According to an embodiment of a washing machine and control method thereof, collisions between parts that are likely to occur during washing or dehydrating operation due to e.g., a reverse load may be prevented, and accordingly, life-shortening of the parts may be prevented and efficiency and economic feasibility of the washing machine may be improved.

According to an embodiment of a washing machine and control method thereof, washing operation and/or dehydrating operation of the washing machine may be controlled properly based on a load property, and accordingly, washing and/or dehydrating performance of the washing machine may be maximized.

According to an embodiment of a washing machine and control method thereof, unbalanced distribution of laundry may be prevented, and accordingly, vibration or unnecessary process, for example, re-try of dehydration due to the unbalanced distribution of the laundry may be prevented or minimized.

Meanwhile, the embodiments of the present disclosure may be implemented in the form of recording media for storing instructions to be carried out by a computer. The instructions may be stored in the form of program codes, and when executed by a processor, may generate program modules to perform operation in the embodiments of the present disclosure. The recording media may correspond to computer-readable recording media.

The computer-readable recording medium includes any type of recording medium having data stored thereon that may be thereafter read by a computer. For example, it may be a ROM, a RAM, a magnetic tape, a magnetic disk, a flash memory, an optical data storage device, etc.

The embodiments of the present disclosure have thus far been described with reference to accompanying drawings. It will be obvious to people of ordinary skill in the art that the present disclosure may be practiced in other forms than the embodiments as described above without changing the technical idea or essential features of the present disclosure. The above embodiments are only by way of example, and should not be interpreted in a limited sense.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A washing machine comprising:

a first tub configured to store water;

a first drum configured to be rotatable in the first tub;

a first driving motor configured to rotate the first drum;

a second tub configured to store water;

a second drum configured to be rotatable in the second tub;

a second driving motor configured to rotate the second drum;

at least one heater configured to heat water stored in at least one of the first tub or the second tub; and a controller configured to:

determine whether the at least one heater and the second driving motor are operating during operation of the first driving motor, control operation of the second driving motor to be stopped and control the first driving motor to be operated when the at least one heater and the second driving motor are operating and when a driving current for the first driving motor during the operation of the first driving motor is greater than a predetermined reference current, and control operation of the second driving motor to resume when the driving current for the first driving motor becomes less than the predetermined reference current for at least a predetermined period of time.

2. The washing machine of claim 1, further comprising:

a current measurer configured to measure the driving current for the first driving motor;

wherein the controller is configured to determine whether the driving current for the first driving motor measured by the current measurer is greater than the predetermined reference current when the at least one heater, the first driving motor, and the second driving motor are operating simultaneously, and control operation of the second driving motor to be stopped when the driving current for the first driving motor is greater than the predetermined reference current.

3. The washing machine of claim 1, wherein the controller is further configured to control the second driving motor to be rotated in a first direction with a first acceleration for a predetermined time in controlling operation of the second driving motor, and control the second driving motor to be rotated in a second direction with a second acceleration after a lapse of the predetermined time;

wherein the first acceleration is less than the second acceleration; and wherein the first direction is a rotational direction opposite to the second direction.

4. The washing machine of claim 3, wherein the controller is further configured to determine a first parameter for controlling operation of the second drum, control the second drum based on a second parameter when the second drum performs an initial operation, determine whether an additional operation of the second drum is required, and control operation of the second drum based on the first parameter when it is determined that the additional operation of the second drum is not required.

5. The washing machine of claim 4, wherein the first parameter comprises at least one of a first operation ratio of the second drum, a first rotational acceleration of the second drum, or a first rotational deceleration of the second drum; and wherein the second parameter comprises at least one of a second rotational acceleration, that is less than the first rotational acceleration, or a second rotational deceleration having an absolute value less than the first rotational deceleration.

6. The washing machine of claim 5, wherein the controller is further configured to determine that the additional operation of the second drum is required when a rotational speed of the second drum has not yet reached a target rotational speed, when an overcurrent is applied to the second driving motor, or when there is unbalanced distribution of laundry in the second drum.

7. The washing machine of claim 1, wherein the controller is further configured to set a load of the second drum to a first load, control operation of the second driving motor based on the first load, set the load of the second drum to a second load when it is determined that a load switching condition is met, and control operation of the second driving motor based on the second load, wherein the load of the second drum is information corresponding to an amount of laundry, and wherein an amount of laundry corresponding to the second load is smaller than an amount of laundry corresponding to the first load.

8. The washing machine of claim 7, wherein the load switching condition comprises at least one of whether a rotational speed of the second drum exceeds a reference speed, whether a rotational acceleration of the second drum exceeds a reference acceleration, or a difference between a target rotational speed and an actual rotational speed.

9. The washing machine of claim 8, wherein the controller is further configured to determine at least one of a difference between a magnitude of a current applied to the second driving motor and a predetermined reference magnitude or a difference between a frequency of a current applied to the second driving motor and a predetermined reference frequency when the load of the washing machine is set to the second load, and set the load of the second drum back to the first load when the at least one difference exceeds a predetermined reference value.

10. The washing machine of claim 1 wherein:

the controller comprises a first processor configured to control the first driving motor and a second processor configured to control the second driving motor; and the first processor is further configured to send a first driving signal to the second processor when the at least one heater is operating and the driving current of the first driving motor is greater than the predetermined reference current.

* * * * *